US011278465B2

(12) United States Patent
Vouga et al.

(10) Patent No.: US 11,278,465 B2
(45) Date of Patent: Mar. 22, 2022

(54) MODULAR EXOSKELETON FOR EXAMPLE FOR SPINAL CORD INJURED PATIENTS

(71) Applicant: ECOLE POLYTECHNIQUE FEDERALE DE LAUSANNE (EPFL), Lausanne (CH)

(72) Inventors: Tristan Vouga, Lausanne (CH); Paul Bertusi, Ecublens (CH); Mohamed Bouri, Chavannes-Renens (CH)

(73) Assignee: Ecole Polytechnique Federale de Lausanne (EPFL), Lausanne (CH)

( * ) Notice: Subject to any disclaimer, the term of this patent is extended or adjusted under 35 U.S.C. 154(b) by 144 days.

(21) Appl. No.: 16/331,473

(22) PCT Filed: Sep. 11, 2017

(86) PCT No.: PCT/IB2017/055463
§ 371 (c)(1),
(2) Date: Mar. 7, 2019

(87) PCT Pub. No.: WO2018/047129
PCT Pub. Date: Mar. 15, 2018

(65) Prior Publication Data

US 2019/0192373 A1 Jun. 27, 2019

(30) Foreign Application Priority Data

Sep. 9, 2016 (EP) ..... 16188172

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 1/0244* (2013.01);
(Continued)

(58) Field of Classification Search
CPC ..... A61H 3/00; A61H 1/024; A61H 1/0244; A61H 1/0262; A61H 2201/149;
(Continued)

(56) References Cited

U.S. PATENT DOCUMENTS 5,432,703 A 7/1995 Clynch et al.
6,141,889 A 11/2000 Baum
(Continued)

FOREIGN PATENT DOCUMENTS

CN 105434145 3/2016
CN 106063760 11/2016
(Continued)

OTHER PUBLICATIONS

International Search Report prepared by the European Patent Office dated Dec. 6, 2017, for International Application No. PCT/IB2017/055463.
(Continued)

*Primary Examiner* — Andrew S Lo
(74) *Attorney, Agent, or Firm* — Sheridan Ross P.C.

(57) ABSTRACT

The invention concerns an exoskeleton made of elements combined or attached together, said elements being adjustable or not and said elements being made in a sandwich construction. The invention also concerns a method to manufacture such an exoskeleton.

14 Claims, 29 Drawing Sheets

(52) U.S. Cl.
CPC ... *A61H 1/0262* (2013.01); *A61H 2201/0192* (2013.01); *A61H 2201/1215* (2013.01); *A61H 2201/149* (2013.01); *A61H 2201/164* (2013.01); *A61H 2201/165* (2013.01); *A61H 2201/1628* (2013.01); *A61H 2201/1676* (2013.01)

(58) Field of Classification Search
CPC .... A61H 2201/0192; A61H 2201/1215; A61H 2201/1628; A61H 2201/164; A61H 2201/165; A61H 2201/1676
See application file for complete search history.

(56) References Cited

U.S. PATENT DOCUMENTS

| | | | | |
|---|---|---|---|---|
| 9,101,451 | B2 | 8/2015 | Chugunov | |
| 10,610,438 | B1 * | 4/2020 | Dines | F16D 11/16 |
| 2010/0204627 | A1 * | 8/2010 | Kazerooni | A61H 1/0266 602/16 |
| 2010/0262054 | A1 | 10/2010 | Summit et al. | |
| 2011/0082578 | A1 | 4/2011 | Stanhope et al. | |
| 2015/0025423 | A1 | 1/2015 | Caires et al. | |
| 2015/0035195 | A1 | 2/2015 | Cirera Santasusana et al. | |
| 2015/0305911 | A1 | 10/2015 | Scchroeder | |
| 2015/0328840 | A1 | 11/2015 | Zachariasen et al. | |
| 2015/0351995 | A1 | 12/2015 | Zoss et al. | |
| 2016/0015532 | A1 | 1/2016 | Lee et al. | |
| 2016/0128890 | A1 * | 5/2016 | LaChappelle | A61F 2/70 623/30 |
| 2016/0158593 | A1 | 6/2016 | Craig et al. | |
| 2017/0065441 | A1 | 3/2017 | Lee et al. | |
| 2017/0242477 | A1 * | 8/2017 | Rubin | G06T 19/006 |
| 2018/0110669 | A1 * | 4/2018 | Rodriguez Leal | A61H 3/00 |
| 2021/0015694 | A1 | 1/2021 | Vouga et al. | |

FOREIGN PATENT DOCUMENTS

| | | |
|---|---|---|
| CN | 106074094 | 11/2016 |
| CN | 106239484 | 12/2016 |
| DE | 202013002572 | 10/2013 |
| EP | 1980224 | 10/2008 |
| EP | 2995284 | 3/2016 |
| GB | 2508204 | 5/2014 |
| JP | H10-202561 | 8/1998 |
| JP | 2013-094322 | 5/2013 |
| WO | WO 95/01141 | 1/1995 |
| WO | WO 98/14143 | 4/1998 |
| WO | WO 98/30176 | 7/1998 |
| WO | WO 01/06579 | 1/2001 |
| WO | WO 2006/055620 | 5/2006 |
| WO | WO 2007/045000 | 4/2007 |
| WO | WO 2008/066856 | 6/2008 |
| WO | WO 2008/111800 | 9/2008 |
| WO | WO 2010/027968 | 3/2010 |
| WO | WO 2013/190495 | 12/2013 |
| WO | WO 2014/138871 | 9/2014 |
| WO | WO 2015/080596 | 6/2015 |
| WO | WO 2015/153633 | 10/2015 |
| WO | WO 2016/128877 | 8/2016 |
| WO | WO 2016/146960 | 9/2016 |
| WO | WO 2017/044093 | 3/2017 |
| WO | WO 2017/069605 | 4/2017 |

OTHER PUBLICATIONS

Written Opinion prepared by the European Patent Office dated Dec. 6, 2017, for International Application No. PCT/IB2017/055463.
Assisted Patent Search No. 17-30131, dated Jul. 4, 2017, 19 pages.
Vouga et al. "TWICE—A Lightweight Lower-limb Exoskeleton for Complete Paraplegics," IEEE, 2017 International Conference on Rehabilitation Robotics (ICORR), Jul. 17-20, 2017, UII Centre, London, UK, pp. 1639-1645.
"Rex Bionics—Reimagining Rehabilitation," Rex Bionics Ltd., 2019, 4 pages.
Adamczyk et al. "The advantages of a rolling foot in human walking," The Journal of Experimental Biology, Oct. 2006, vol. 209, No. 20, pp. 3953-3963.
Baud et al. "Bio-inspired standing balance controller for a full-mobilization exoskeleton," IEEE, 2019 IEEE 16th International Conference on Rehabilitation Robotics (ICORR), Jun. 24-28, 2019, Toronto, Canada, pp. 849-854.
Clauser et al. "Weight, Volume and Center of Mass of Segments of the Human Body," Defense Technical Information Center, Aug. 1969, Fort Belvoir, VA, Tech. Rep., 112 pages.
Donati et al. Long-Term Training with a Brain-Machine Interface-Based Gait Protocol Induces Partial Neurological Recovery in Paraplegic Patients, Aug. 2016, Scientific Reports, vol. 6, No. 1, Article 30383, 16 pages.
Emmens et al. "Effects of a powered ankle-foot orthosis on perturbed standing balance," Journal of NeuroEngineering and Rehabilitation, 2018, vol. 15, Article 50, 13 pages.
Emmens et al. "Improving the Standing Balance of Paraplegics through the use of a Wearable Exoskeleton," IEEE, 2018 7th IEEE International Conference on Biomedical Robotics and Biomechatronics (Biorob), Aug. 26-29, 2018, Enschede, The Netherlands, pp. 707-712.
Fang et al. "Anthropometric and Biomechanical Characteristics of Body Segments in Persons with Spinal Cord Injury," Journal of Biomechanics, Apr. 2017, vol. 55, pp. 11-17.
Farkhatdinov et al. "Assisting Human Balance in Standing With a Robotic Exoskeleton," IEEE Robotics and Automation Letters, 2019, vol. 4, No. 2, pp. 414-421.
Fasola et al. "Balance Control Strategies during Standing in a Locked-Ankle Passive Exoskeleton," IEEE, 2019 IEEE 16th International Conference on Rehabilitation Robotics (ICORR), Jun. 24-28, 2019, Toronto, CA, 6 pages.
Griffin et al. "Stepping Forward with Exoskeletons: Team IHMC's Design and Approach in the 2016 Cybathlon," IEEE Robotics & Automation Magazine, Dec. 2017, vol. 24, No. 4, pp. 66-74.
Harib et al. "Feedback Control of an Exoskeleton for Paraplegics: Toward Robustly Stable, Hands-Free Dynamic Walking," IEEE Control Systems Magazine, Dec. 2018, vol. 33, No. 6, pp. 61-87.
Patla et al. "Anticipatory control of center of mass and joint stability during voluntary arm movement from a standing posture: interplay between active and passive control," Experimental Brain Research, Apr. 2002, vol. 143, No. 3, pp. 318-327.
Rajasekaran et al. "An adaptive control strategy for postural stability using a wearable robot," Robotics and Autonomous Systems, Nov. 2015, vol. 73, pp. 16-23.
Schrade et al. "Development of VariLeg, an exoskeleton with variable stiffness actuation: first results and user evaluation from the CYBATHLON 2016," Journal of NeuroEngineering and Rehabilitation, Dec. 2018, vol. 15, No. 1, 18 pages.
Schütz "Robotic exoskeleton: Fora better quality of life," Maxon, Jan. 31, 2012, 4 pages.
Winter "Human balance and posture control during standing and walking," Gait & Posture, Dec. 1995, vol. 3, No. 4, pp. 193-214.

* cited by examiner

MODULAR EXOSKELETON FOR EXAMPLE FOR SPINAL CORD INJURED PATIENTS

CROSS REFERENCE TO RELATED APPLICATION

This application is a national stage application under 35 U.S.C. 371 and claims the benefit of PCT Application No. PCT/IB2017/055463 having an international filing date of 11 Sep. 2017, which designated the United States, which PCT application claimed the benefit of European application No16188172.7 filed on Sep. 9, 2016 in the name of ECOLE POLYTECHNIQUE FEDERALE DE LAUSANNE (EPFL), the disclosure of each of which are incorporated herein by reference.

FIELD OF THE INVENTION

The present invention concerns the field of exoskeletons for disabled patients or used for rehabilitation of injured patients or to replace the lost function of a body part. The application of the present invention is however not limited to the medical field and such exoskeletons may be used in many other applications, also with valid users.

A lower limb exoskeleton is a mechatronic system adapted to be attached to a person's lower limb and trunk. It enables mobilization of the legs of the user by the means of actuators. This mobilization enables, for example, a person with disabilities to move and perform actions such as standing up, walking, climbing stairs or standing with other individuals in community. It may also be used to assist or replace a lost limb (for example after an accident), for rehab, or to provide support and/or strength to the said limb(s). For example, the limb may be an upper limb such as the arm or the limb may be a lower limb such as the leg.

Preferably, the device has a serial arrangement of joints and segments, similar to the one of a human. It acts in parallel to the body and exerts forces to the body in order to impose a certain position.

In the particular case of complete paraplegic patients, the exoskeleton is in charge of all the support and therefore is moving or displacing the user without the latter having to use any muscle force.

In other cases and applications, the exoskeleton may follow the movement of the user and, for example provide more stability or strength to the user that may be a valid person. Also, the exoskeleton may assist or replace a different body part: it can be used for an upper limb, such as the arm.

An example of an exoskeleton is given in US 2015/035195. This exoskeleton can be reconfigured, adjusted and/or controlled on the fly utilizing devices which fall into three categories, particularly including a swappable unactuated leg, lockable transverse and coronal hip rotations, and software controlled free joints. The various devices can be used either alone or in combination to enable any given exoskeleton to be appropriately reconfigured, such as when a patient progresses during therapy.

Publication DE 202013002572 discloses another example of an exoskeleton, i.e. a non-grounded, portable and reconfigurable external skeleton apparatus for ankle therapy and measurement, comprising: a base platform opposing the user's leg, a movement platform opposing the user's foot; A connecting member connecting the base platform and the movement platform, a hinge member connecting the connecting member to the base platform

Challenges of the Present Invention

Among people with reduced mobility, the variety of impairments is tremendous. In fact, even specific pathologies such as spinal cord injury, can have extremely different consequences for the patient's diagnostic. To reflect this variety, an equally high number of different devices should be developed in order to address the needs of all patients. This does not encourage the manufacturing of products in large-series, but rather calls for specific, small-series products, tailored to each patient. Keeping such products affordable is a great challenge, given the fact that price reduction usually arises from growing series sizes.

Some manufacturing techniques are well-suited for small series while keeping a relatively low unit cost. However, they usually have a great lack of performance in terms of mechanical resistance, dimensional accuracy, appearance and overall feeling of quality.

In the present design, a specific manufacturing technique was selected and enhanced to enable the production of custom, tailored, small-series exoskeletons, at an affordable production price per unit and while keeping outstanding mechanical performance and high-quality appearance.

Of particular interest, the manufacturing technique according to the present invention was adapted in specific cases, to enable the manufacturing of complex geometries required for the advanced functions that an exoskeleton embodies and fulfills.

In addition of the lightweight aspect of these structures, the fact that they enable the creation of custom exoskeletons in much shorter time delays than with other state-of-the-art techniques is of great advantage. Using this technique, a tailored exoskeleton can be produced within a few days, which would be impossible with standard industrial processes which require important tooling, such as injection molding. Other rapid prototyping techniques such as fuse-deposition manufacturing do not fulfil the high strength requirements of such applications as orthotics.

In an embodiment, using semi-finished products of carbon fiber composite, wood and a 3-axis milling machine, one built a sandwich structure for the different parts of the exoskeleton that is adjustable in length while maintaining the remarkable properties of sandwich structures.

Indeed, precisely fitting the exoskeleton to the user is crucial to avoid internal constraints during motions and displacement. Joint misalignment will create disturbing tensions which are to be avoided in the present circumstances. Not only it will lead to constraints in the segments, but more importantly it can harm the user if the internal constraints are too important.

However, building an exoskeleton structure that is adjustable in length is not trivial. Especially when it must withstand combined loads in all directions, as it is the case with exoskeletons. Many existing mechanisms could serve as an example for this feature: a telescopic crane; a drawer; a photography tripod. But all these devices have loads in only one direction, and are moreover preloaded by gravity.

In the case of exoskeletons, not only the sign of the load changes twice per cycle, but the type of load varies among all combinations of traction, compression, flexion and torsion throughout the gait cycle.

Apart from the adjustment feature, this technology is of interest for the following reasons: it is easy to manufacture (the machine required for sufficient accuracy can be acquired for a reasonable cost) and lightweight (the structure accounts for ~10% of the segment's weight).

Producing an exoskeleton with this manufacturing process would not be possible without many adjustments and techniques described in this invention.

Sandwich structures are usually very advantageous in terms of mechanical properties over density for large parts which span on wide surface areas. They are hard to mount upon as they cannot be threaded nor clamped with bolts.

The present application explains how this particular manufacturing process was adapted for the fabrication of exoskeletons.

Of course, this is only an example and other equivalent techniques may be used in the present context to produce such exoskeleton and parts thereof in accordance with the principles of the present invention.

Accordingly, it is an aim, among several other aims, of the present invention to provide a manufacturing method and exoskeletons made by this method that are improved over the prior art as discussed hereabove.

Other aims and advantages of the present invention will become apparent from the following description.

BRIEF DESCRIPTION OF THE INVENTION

In an embodiment, the invention concerns a method for manufacturing an exoskeleton, whereby said exoskeleton comprises at least articulated segments forming the structure of the exoskeleton, means for attaching the exoskeleton to a user and joints between said segments and/or said means, in which method said segments are formed by a sandwich construction of layers of materials assembled together. The means for attaching the exoskeleton may be straps, Velcro® straps, belts and other equivalent means.

In an embodiment of the method, the exoskeleton is a limb exoskeleton comprising at least two segments.

In an embodiment of the method, the segments are formed from at least two parts for allowing an individual length adjustment of said segments.

In an embodiment of the method, the exoskeleton is a lower limb exoskeleton with the at least two segments forming a thigh and a shank of a leg.

In an embodiment of the method, the exoskeleton is an upper limb exoskeleton with the at least two segments forming a forearm and an arm.

In an embodiment of the method, the layers of material are the same materials or different materials.

In an embodiment of the method, the layers of material are shaped and then attached together.

In an embodiment of the method, the layers are shaped by cutting.

In an embodiment of the method, the layers are attached together by gluing.

In an embodiment of the method, the sandwich construction comprises at least three layers of material, preferably five layers of material. Other variants are of course possible.

In an embodiment of the method, the segments are made of layers of high strength and/or density material and low strength and/or density material.

In an embodiment, the invention concerns an exoskeleton manufactured by a method as defined herein.

In an embodiment, the invention concerns an exoskeleton comprising articulated segments forming the structure of the exoskeleton, means for attaching said exoskeleton to a user and joints between said segments and/or said means, wherein at least said segments are formed by layers of material assembled together in a sandwich construction. The means for attaching the exoskeleton may be straps, Velcro® straps, belts and other equivalent means.

In an embodiment, the exoskeleton is a limb exoskeleton comprising at least two articulated segments via a joint. It may also comprise more than two segments, preferably made in accordance with the principles of the present invention.

In an embodiment, the segments are formed from at least two parts for allowing an individual length adjustment of said segments. The segments may also comprise more than two parts.

In an embodiment, the exoskeleton is a lower limb exoskeleton wherein the two articulated segments form a thigh and a shank of a leg.

In an embodiment, the exoskeleton is an upper limb exoskeleton with the at least two segments forming a forearm and an arm.

In an embodiment, the layers of material are the same materials or different materials or a mix therefrom.

In an embodiment, the sandwich construction comprises at least three layers of material, preferably five layers of material. It is also possible to use less than three layers or more than five, using the principles of the present invention.

In an embodiment, the segments are made of layers of high strength and/or density material and low strength and/or density material.

In an embodiment, the joints comprise a motor for a joint actuation and may also comprise other transmission elements (belts, redactors, drives etc) as will be described in more detail herein.

In one embodiment, the exoskeleton comprises means for a movable plane conversion and/or means for a fixed plane conversion. One plane may be the sagittal plane and the other plane may be the horizontal plane.

In one embodiment, the exoskeleton comprises reinforcement means, for example reinforcement plates. Such means are useful to support tightening means and also to compensate shear stresses and/or compressive loads in the structure.

In one embodiment, the exoskeleton further comprises a transmission actuated by the motor, for example a belt transmission.

In one embodiment, the exoskeleton comprises means for tensioning said belt, for example by a length adjustment, a tensioning mechanism.

The invention will be better understood from a detailed description of embodiments therefrom and from the drawings which show FIG. 1 illustrates a perspective view of an embodiment of an exoskeleton according to the present invention;

DETAILED DESCRIPTION OF THE INVENTION

The following description will refer to the attached FIGS. 1 to 30 that illustrates an exoskeleton and parts of it in non-limiting embodiments of the present invention.

The segments are the mechanical structure constituting the rigid skeleton of the device. They link the different elements of the device. In an embodiment, there are two segments per leg: one corresponding to the thigh 2100 and one to the shank 3100, see FIG. 1.

Figure 1:
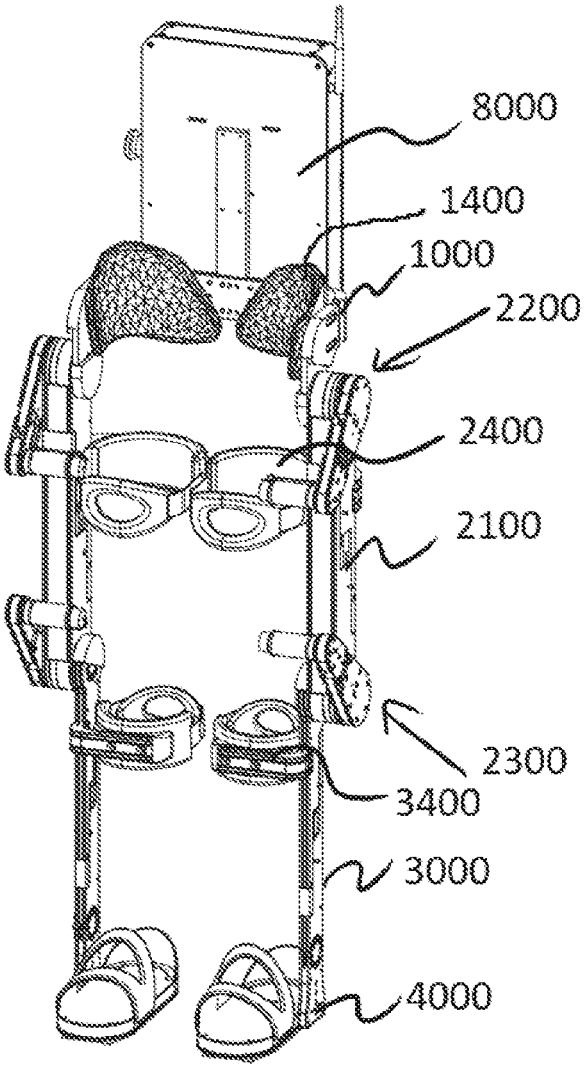
Figure 2:
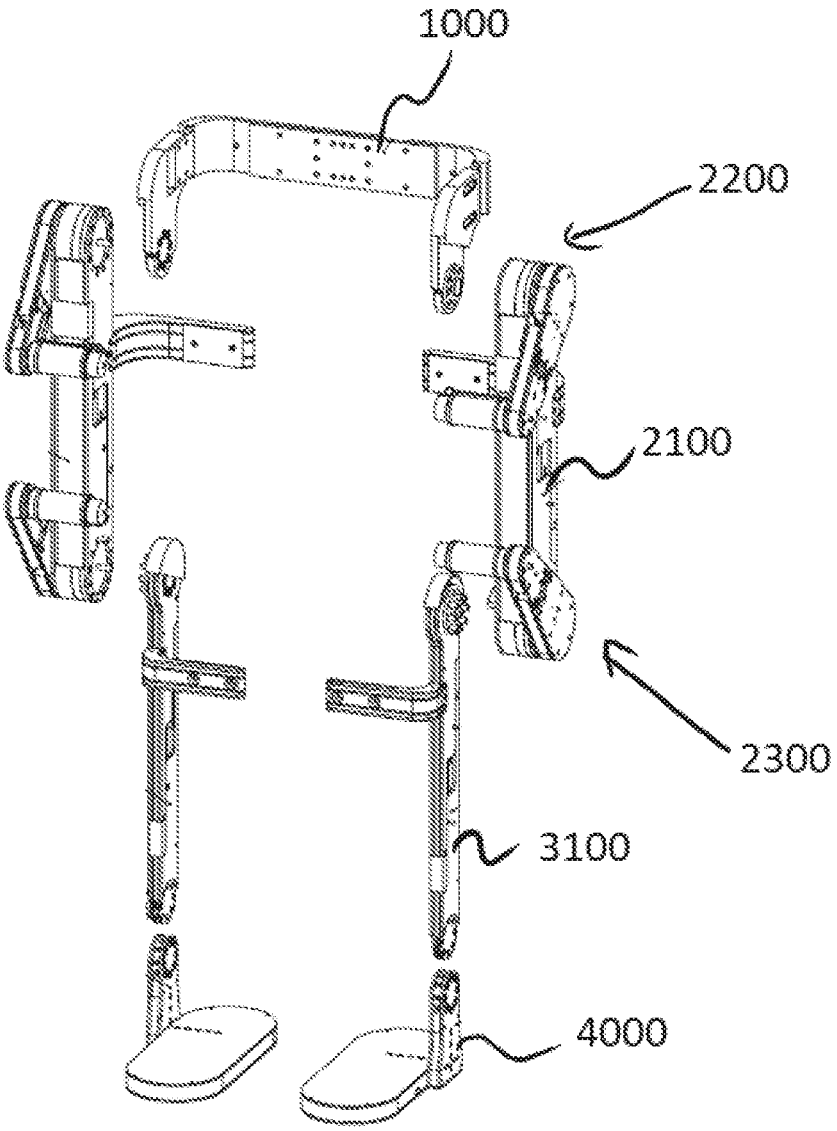
FIG. 2 illustrates a perspective and exploded view of an embodiment of an exoskeleton according to the present invention.
Figure 3:
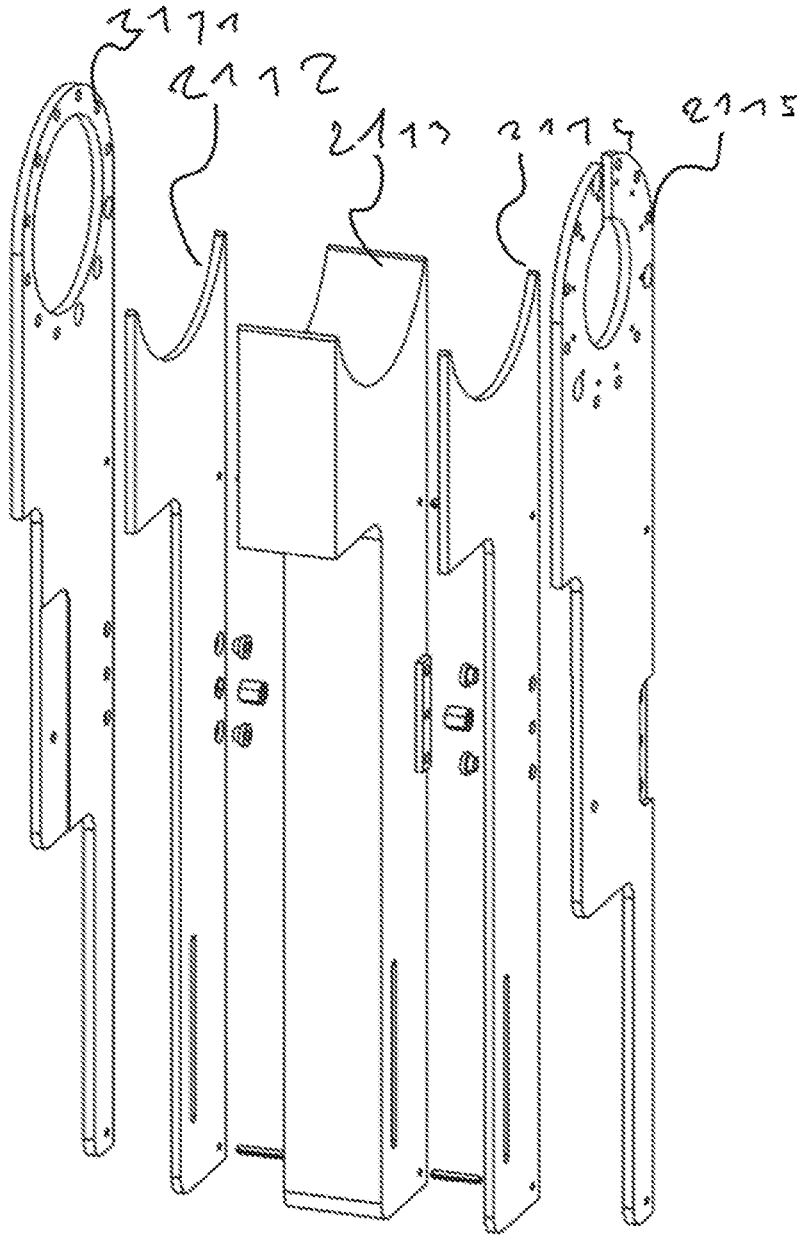
FIG. 3 illustrates in a perspective and exploded view a part of an embodiment of an exoskeleton according to the present invention.
Figure 4:
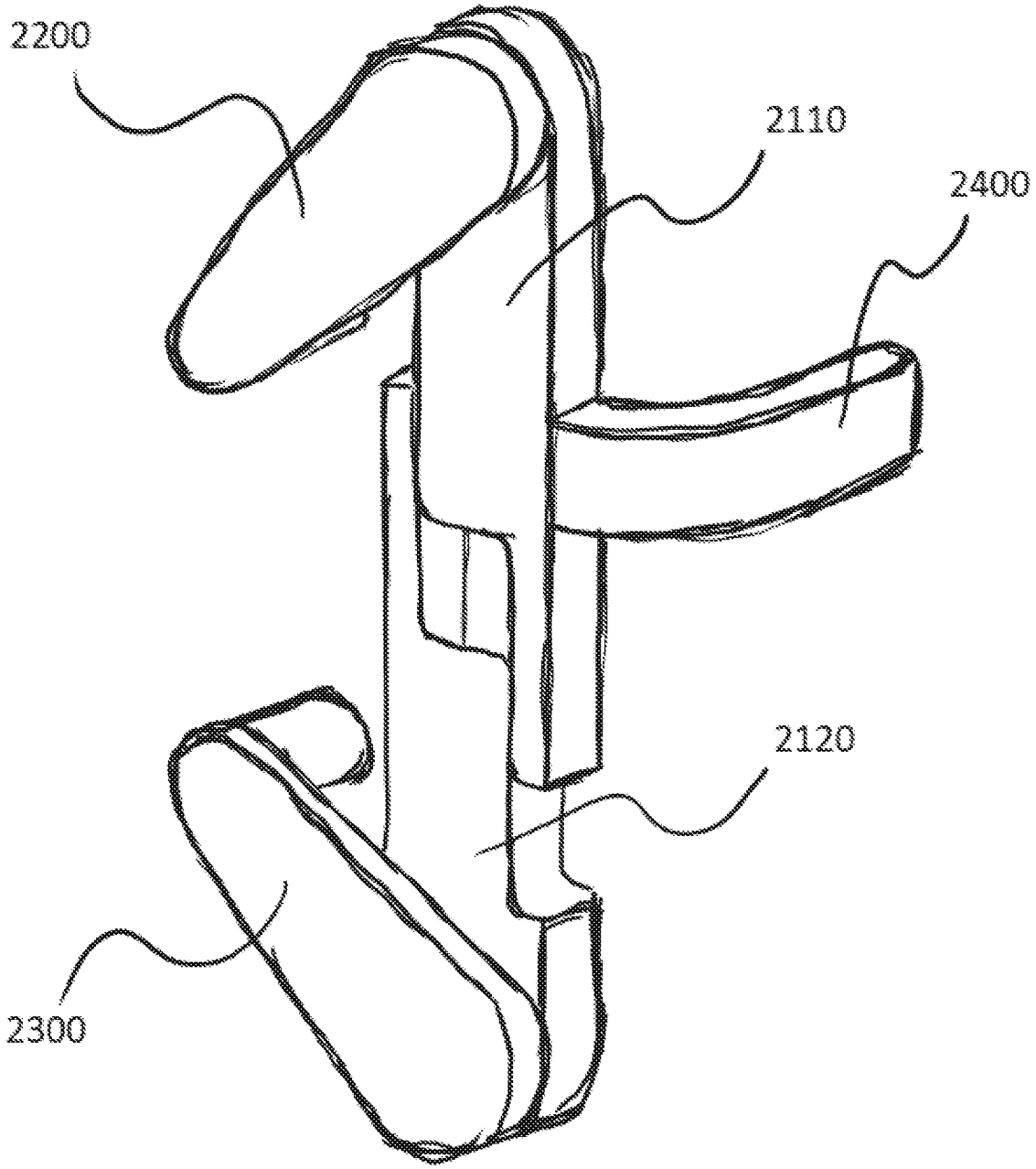
FIGS. 4 and 5 illustrate side and perspective views of parts of an embodiment of an exoskeleton according to the present invention.

The back structure 1000 creates the link between the two legs and holds a control unit 8000, see FIG. 1. The back structure may also be considered a segment in the frame of the present invention and possess the features of a segment as defined herein.

At the intersection of the segments, mechanical joints 2200, 2300 (FIG. 1) enable the modification of the spatial configuration of the device. The joints of an embodiment of the invention are preferably all of a revolute type: they only permit one degree of freedom. They transmit forces and moments of forces in all other directions and around all axes other than the one they control.

The interfaces 2400, 3400 create the link between the exoskeleton and the user. They make a mechanical connection between the hard, mechanical parts of the exoskeleton and the human body parts. They enable the transmission of forces to the user's body, thus enabling the determination of the user's spatial conformation. They can be either a separate part, or included/integrated in the segment.

The foot plate 4000 supports the user's foot and shoe and provides fixation points for a stable connection to the user's foot. It is in contact with the ground and transmits forces from the ground up to the shank segment. As it is understood, such a footplate is an optional feature and in some embodiments the exoskeleton does not have such a plate, or only as an option.

The control unit 8000 encompasses the electronic components required to control the motors towards a desired position, drive the electrical current from batteries to motors, store energy (batteries) and run the software that constitutes the device's intelligence. In an embodiment, the control unit is located on the exoskeleton, but it could also be placed in a remote place, for example as a remote control, or partially on the exoskeleton and partially remote. The connection may by wired or wireless according to known technologies.

The cables transmit the power from the control unit to the motors in case assistance is needed. Of course, other equivalent means are possible.

In an embodiment, two degrees of freedom are actuated. The other joints are completely fixed and cannot be moved, either passively or actively. The two joints that are preferably active correspond to the hip and knee joints, for example. They are specifically oriented in flexion/extension thus enabling motion of the leg in the sagittal plane.

In other designs and embodiments, other joints may be moved and may be active, passively free to move, or linked via a passive element such as a spring or a damper.

Length Adjustment

As mentioned above in the challenges, the precise fitting of an exoskeleton to the user is crucial to avoid internal constraints during motions and displacement as joint misalignment will create disturbing tensions which are to be avoided in the present circumstances. Not only it will lead to constraints in the segments, but more importantly it can harm the user if the internal constraints are too important.

The Manufacturing Process

In an embodiment, the process used to create composite sandwich parts forming the elements of the exoskeleton comprises two main steps: a cutting step for shaping the layers to be used and a gluing or assembly step to attach the layers together thus forming the desired elements. In some embodiments, the steps may be inverted with the assembly step being carried out firstly and then the shaping step.

Cutting: The individual parts are cut, preferably using a 3-axes CNC machine, a water-jet cutting machine, a laser cutting machine or another equivalent technique suitable for the purpose.

In an embodiment, stock is made of sheets of pre-impregnated carbon fiber composite and a low-density core material. This lightweight core can be made of different materials, such as wood, open- and closed-cell foams, honeycomb structure, thermoplastics or thermoset. Typical thickness of the carbon fiber composite sheets is 1.5 mm to 3 mm. In some cases, holes (for the assembly) needing a precise tolerance can be reworked after cutting to match the tolerance requirements.

In other cases, the carbon-fiber sheets can be replaced by other high-strength materials, such as glass-, Kevlar- and Dyneema-fiber composites, aluminum, magnesium, titanium or steel.

Assembly: In the case of glueing, the parts are covered preferably with epoxy on each side that is in contact with another part. Glue deposition needs to be consistent to ensure good adherence, avoid overfilling of holes and ensure parallelism of the glued parts. Typical thickness of glue layer on each part is 70-150 μm. Other appropriate glues such as bismaleimide, phenolic, polyimide, cyanate ester, acrylic, polyurethane based glues, and other glueing techniques are of course possible.

When glueing is inappropriate, other assembly means or techniques may be implemented in combination with glueing or not. These include using dowel pins to transmit shear forces between the different layers, thus ensuring good flexion resistance.

Because of the manufacturing process used as described herein, it was also necessary to develop specific geometries of the different parts as illustrated in the appended drawings in order to be able to fabricate such parts with this process and at the same time assemble such parts to form the exoskeleton.

Detailed Description of the Subsystems of the Exoskeleton

Thigh Segment (see FIGS. 3 to 7)

The segment 2100 can be made in two variations: adjustable/variable in length or with fixed length.

Variable Length Version (FIGS. 3, 4, 6, 7)

The adjustable thigh segment includes two main parts 2110, 2120 which are made to slide with respect to each other, enabling a variation of the distance between the two ends of the segment. This enables to accommodate different users with different thigh length without creating internal stresses during use.

Figure 6:
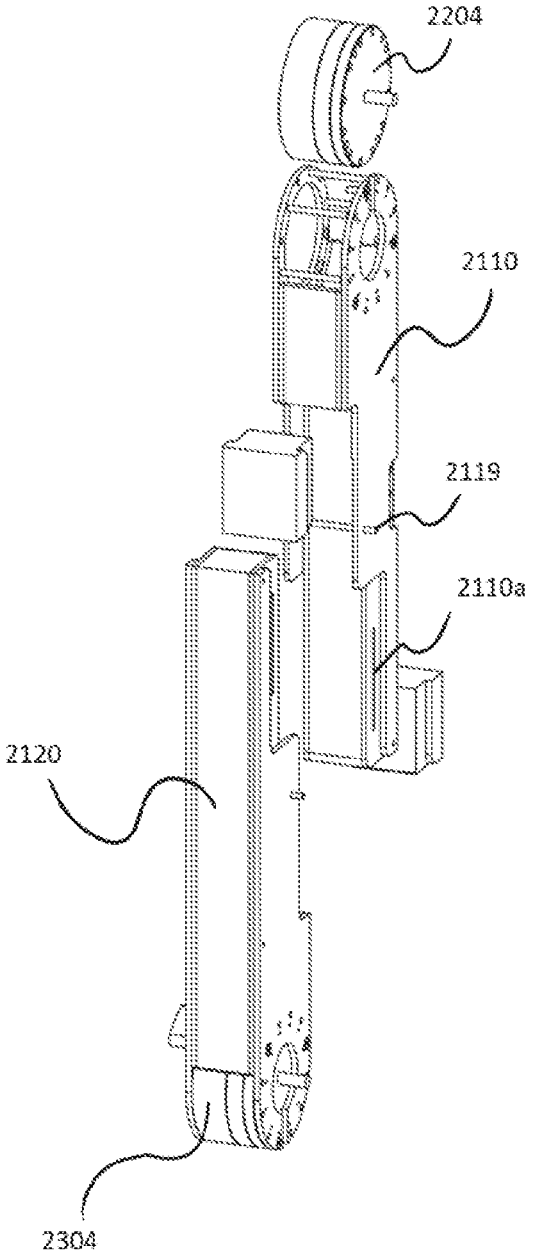
FIG. 6 illustrates a perspective view of a part of an embodiment of an exoskeleton according to the present invention.
Figure 7:
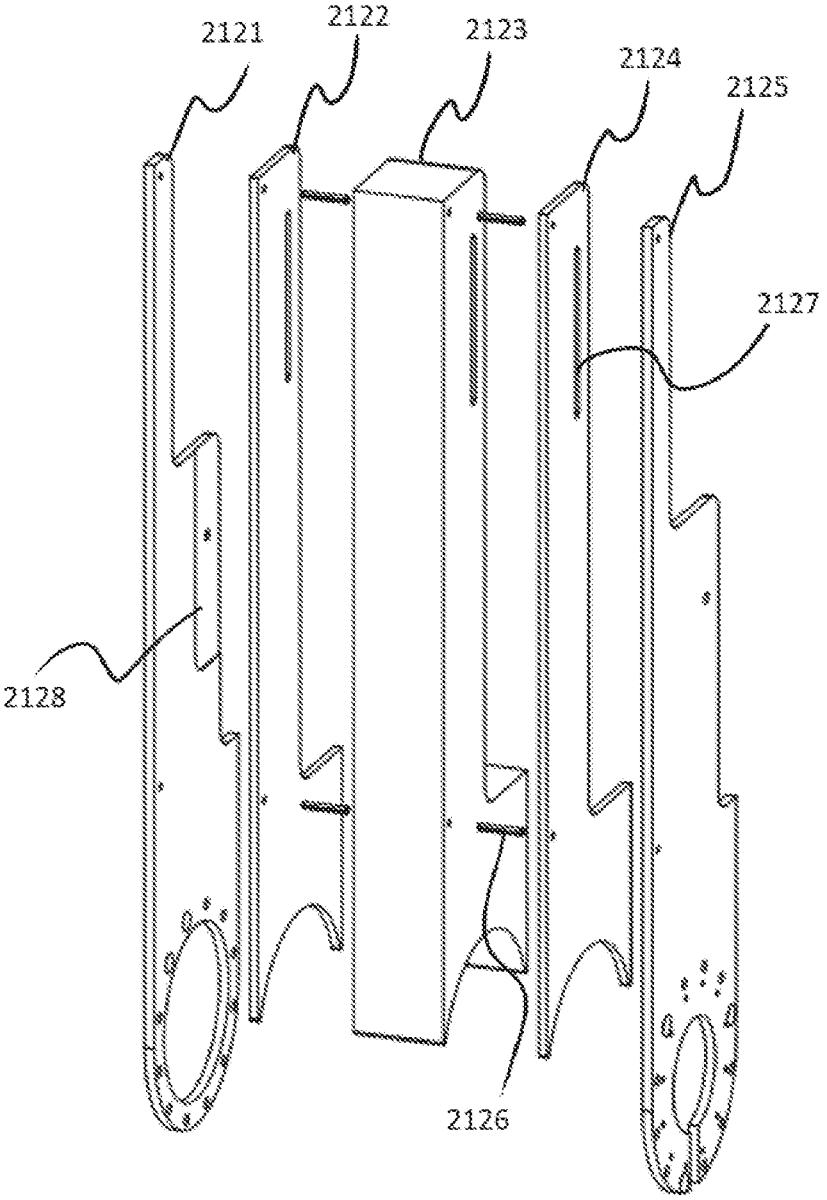
FIG. 7 illustrates a perspective view of a part of an embodiment of an exoskeleton according to the present invention.

In one embodiment, the superior (upper) half 2110 and inferior (lower) half 2120 both have preferably the same structure. In an embodiment for example, they are made of a 5-layers sandwich. FIGS. 6-7: Four layers 2111, 2112, 2114, 2115 (FIG. 3) are made of high-strength material, such as carbon fiber composite, aluminum, steel, or other fiber reinforced polymer, and the middle layer 2113 is made of lower-strength material and lower density, such as polymer foam, wood, honeycomb structures. This configuration enables a high bending modulus while keeping an overall low weight. All parts are manufactured (cut and assembled) using the aforementioned techniques as a possible realization.

The outer layers of one half 2111, 2115 have a shape such that they:

1. overlap with the inner high-strength layers of the other half 2122, 2124 and
2. uncover a portion of the inner high-strength layers of their same half (2112,2114). The outer layers of the other half play a similar role, respectively.

Figure 15:
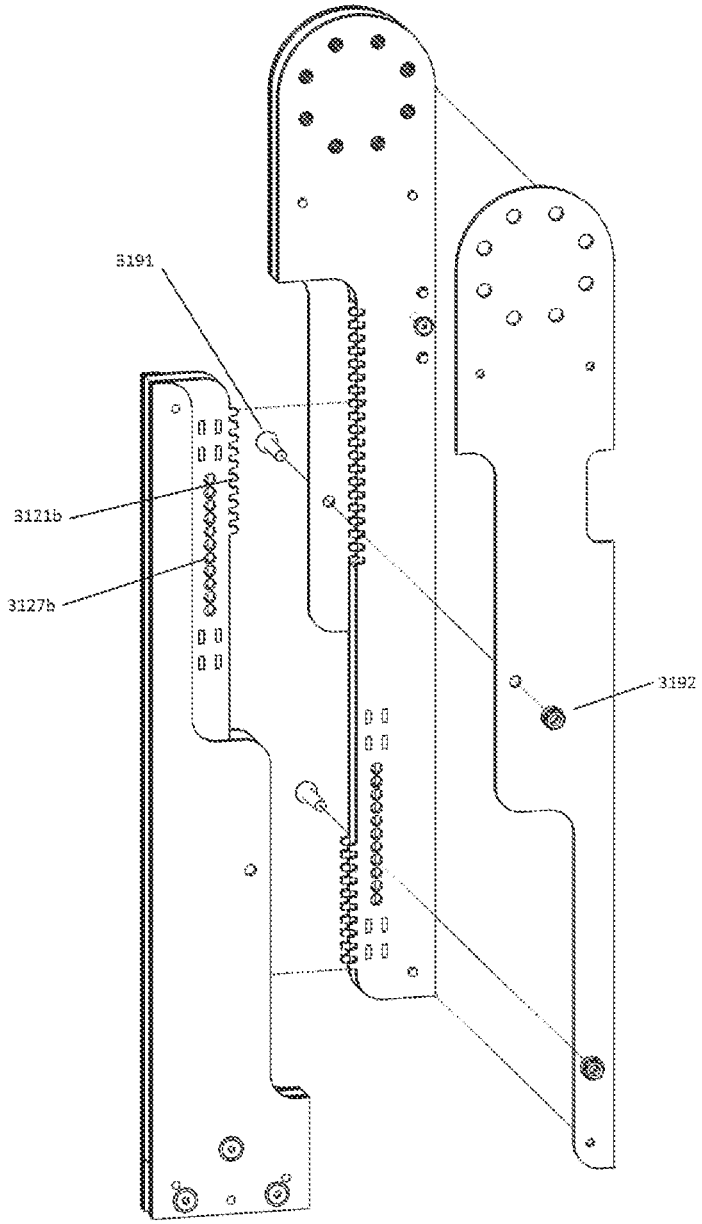
FIG. 15 illustrates an embodiment of a part of the exoskeleton according to the invention.
Figure 16:
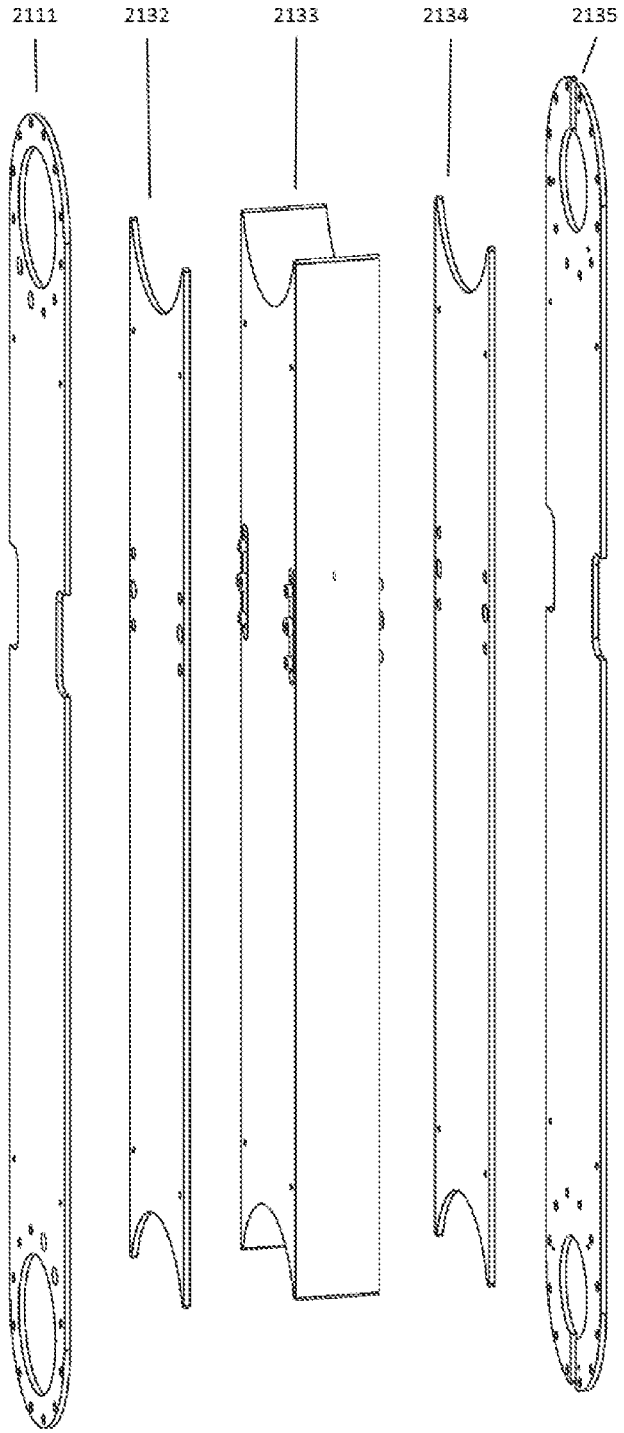
FIG. 16 illustrates an embodiment of another part of the exoskeleton according to the invention.

In order to maintain a given distance between the parts once set at the desired position/overall length, a fastening apparatus with fastening means is implemented. It comprises for example a screw 2119, 3191 (or any other traction clamping mean) going through the two outer layers of one half 2111, 2115 and through the three inner layers of the other half 2122, 2123, 2124, tightened using a nut 3192. To enable length adjustment, the hole going through the three inner layers of the other half 2122, 2123, 2124 is a long hole 2127*a*/3110*a* or an array of discrete holes 2127*b*. If necessary, the portion of the inner surface of the outer layer which is in contact with the inner layer of the other half 2118 can be covered or coated with another material 3111*a* (e.g. rubber) or comprise specific means, to enhance the friction between the two halves and thus increase the maximum load that the system can support before sliding. Other equivalent means may be used as well for the same purpose as described herein, such as depicted in FIG. 15, 3121*b*. This example uses five layers but it is possible to increase the number of layers or reduce it according to circumstances, for example (but not limited to) depending on the size of the exoskeleton, the part considered, etc.

Figure 5:
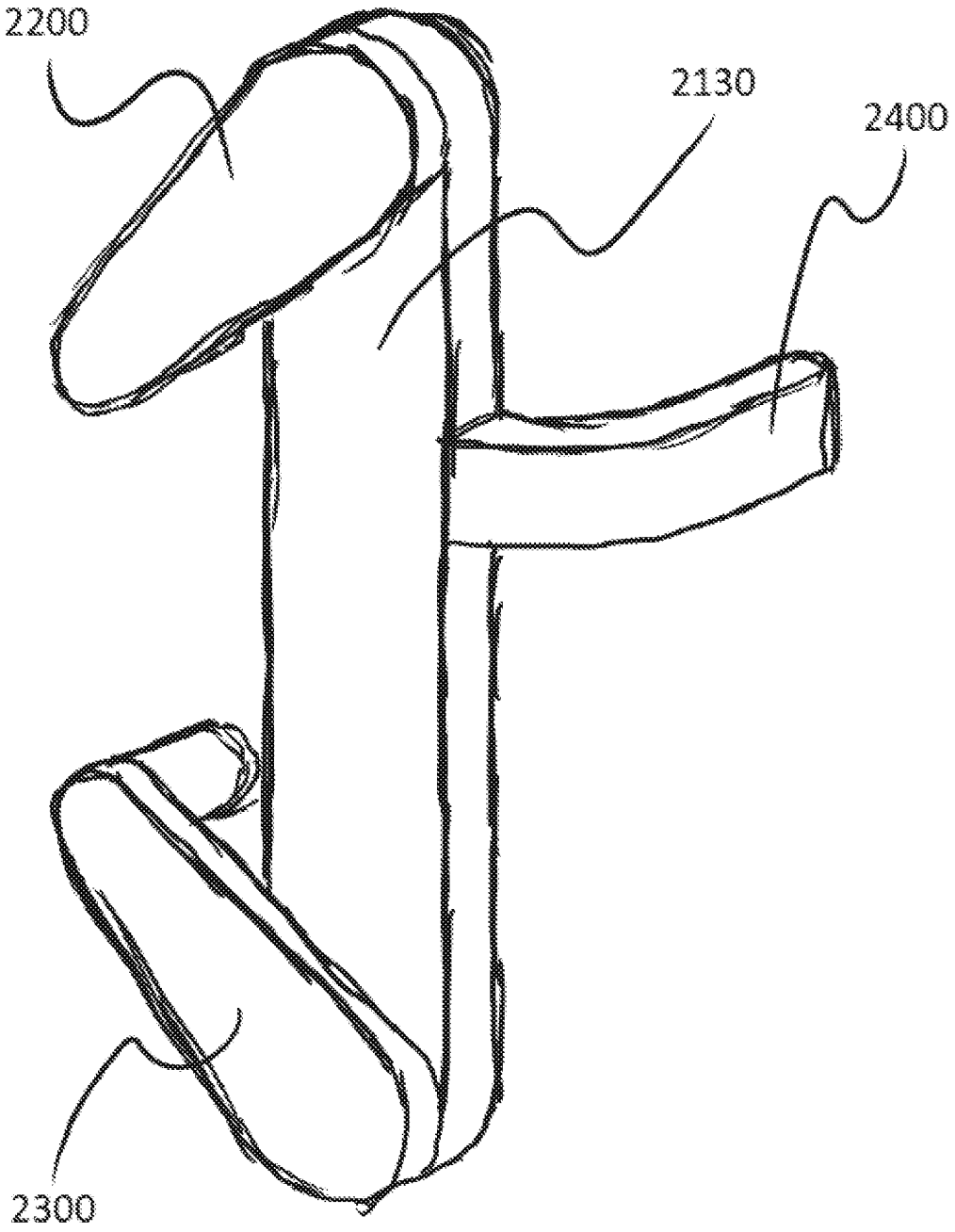

Fixed Length Version (FIG. 5)

The fixed length version of the thigh segment has only one part linking the two joints 2130. It is also made of five layers created with afore-mentioned manufacturing process: the four outermost layers are made of high-strength material 2131, 2132, 2134, 2135, and the innermost layer is made of lower-strength and lower-density material 2133. This 5-fold sandwich structure confers the same high-performance properties (low weight, high stiffness and high-strength) while allowing for good fastening possibilities (for the joints and interface fixation for instance). This example uses five layers but it is possible to increase the number of layers or reduce it according to circumstances, for example depending on the materials used or the size of the exoskeleton.

Fastening with Joints

The fastening between the segments 2110, 2120 and the joints 2200, 2300 is made preferably by clamping the joint between the two outermost layers of one half 2111, 2115, 2121, 2125 using fasteners.

Fastening with Interface Fixation

The fastening with the interface fixations 2400 is made using a special plane-conversion mechanism. This mechanism is described below. The one used for the interfaces is the movable one, to allow for changes of interfaces according to the patient's morphology.

Shank Segment (FIGS. 8 to 16)

Figure 8:
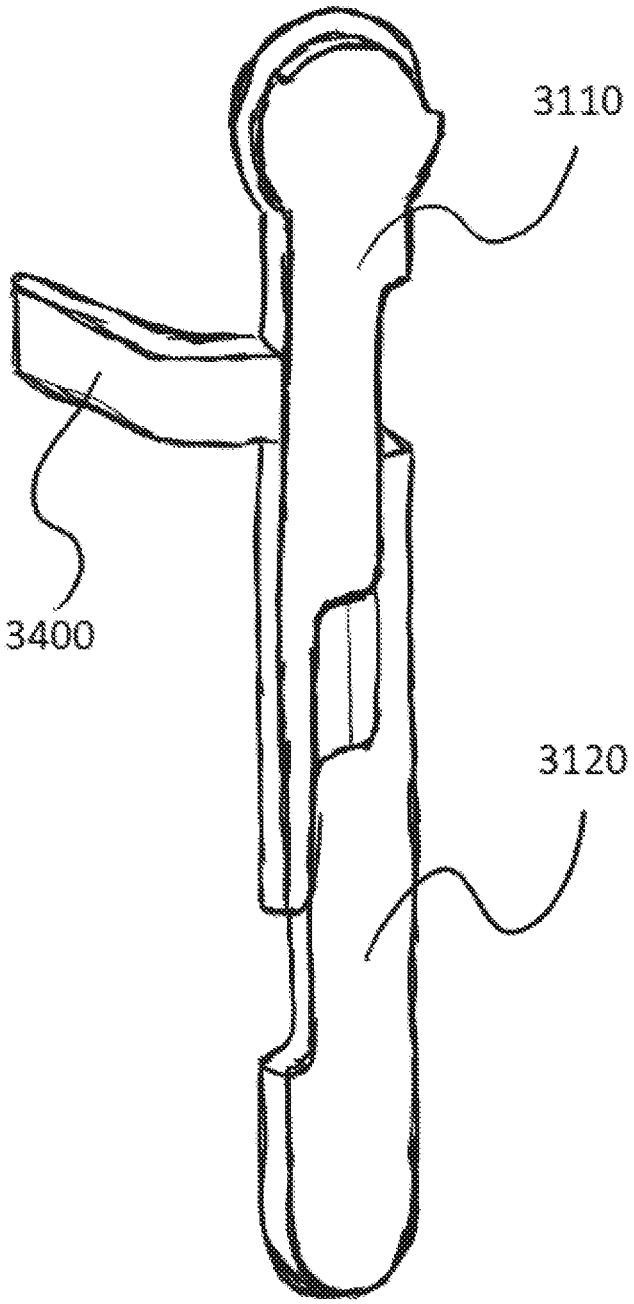
FIGS. 8 and 9 illustrate side and perspective views of parts of an embodiment of an exoskeleton according to the present invention.
Figure 9:
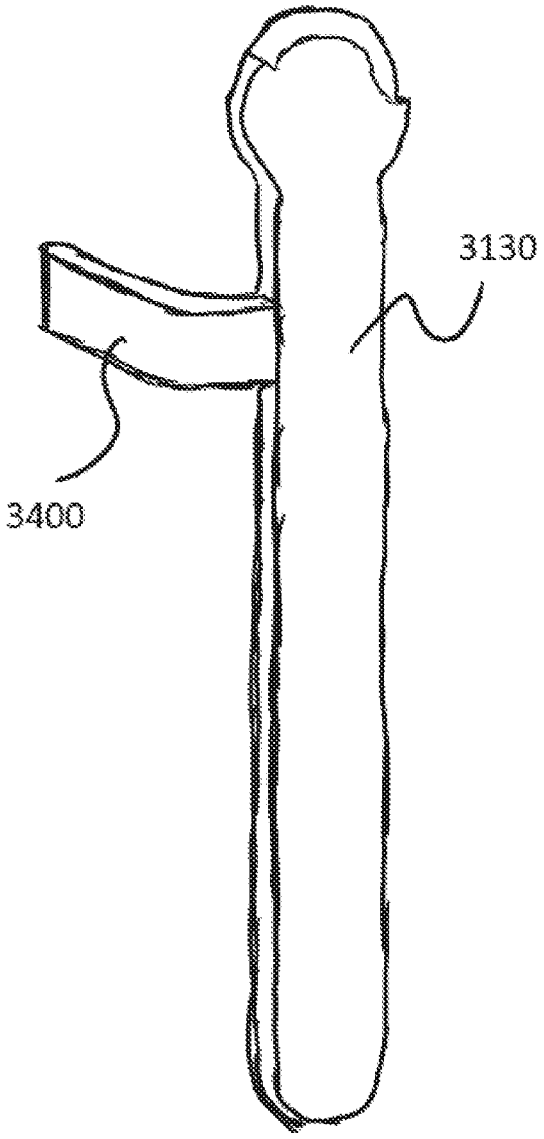
Figure 10:
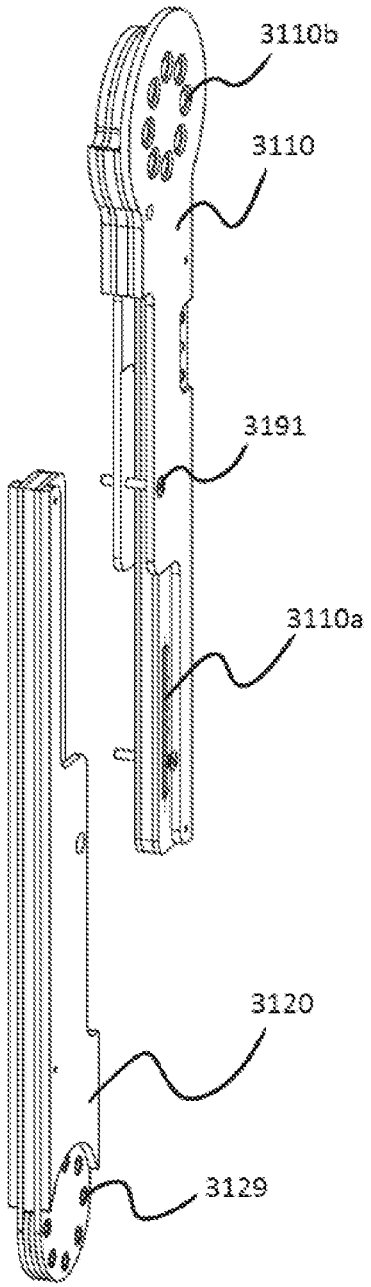
FIGS. 10 to 12 illustrate perspective views of parts of an embodiment of an exoskeleton according to the present invention.
Figure 11:
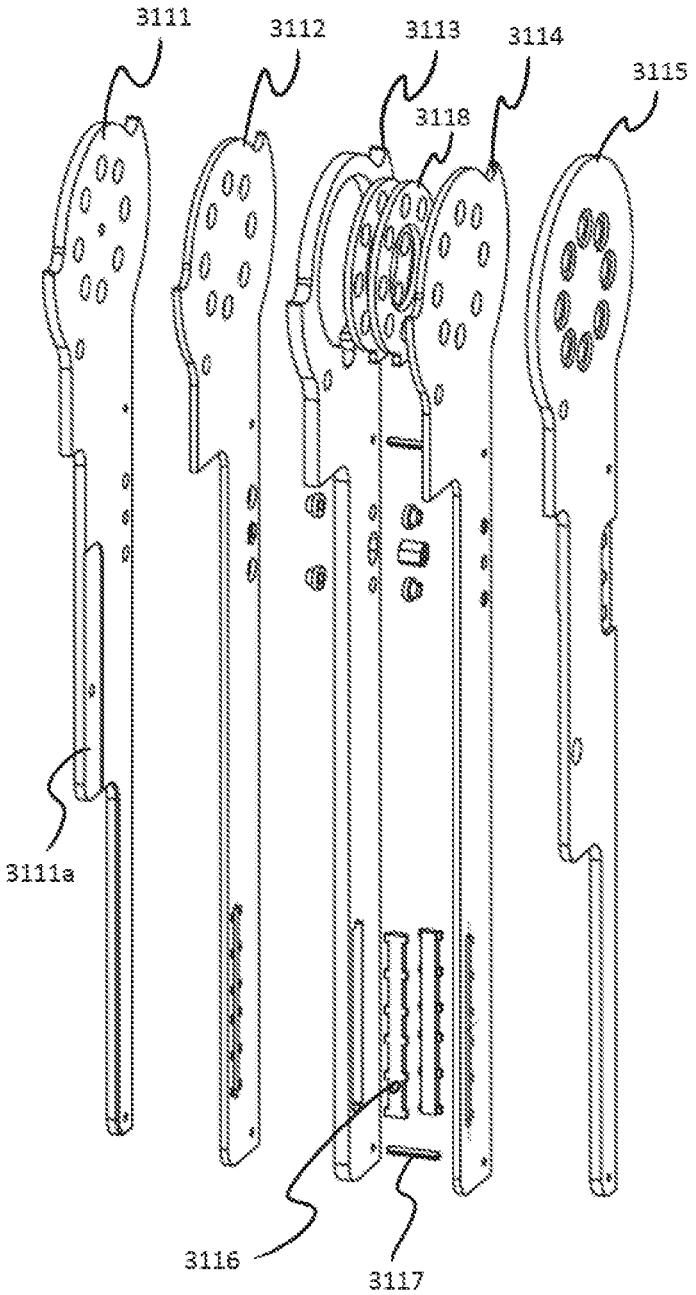
Figure 12:
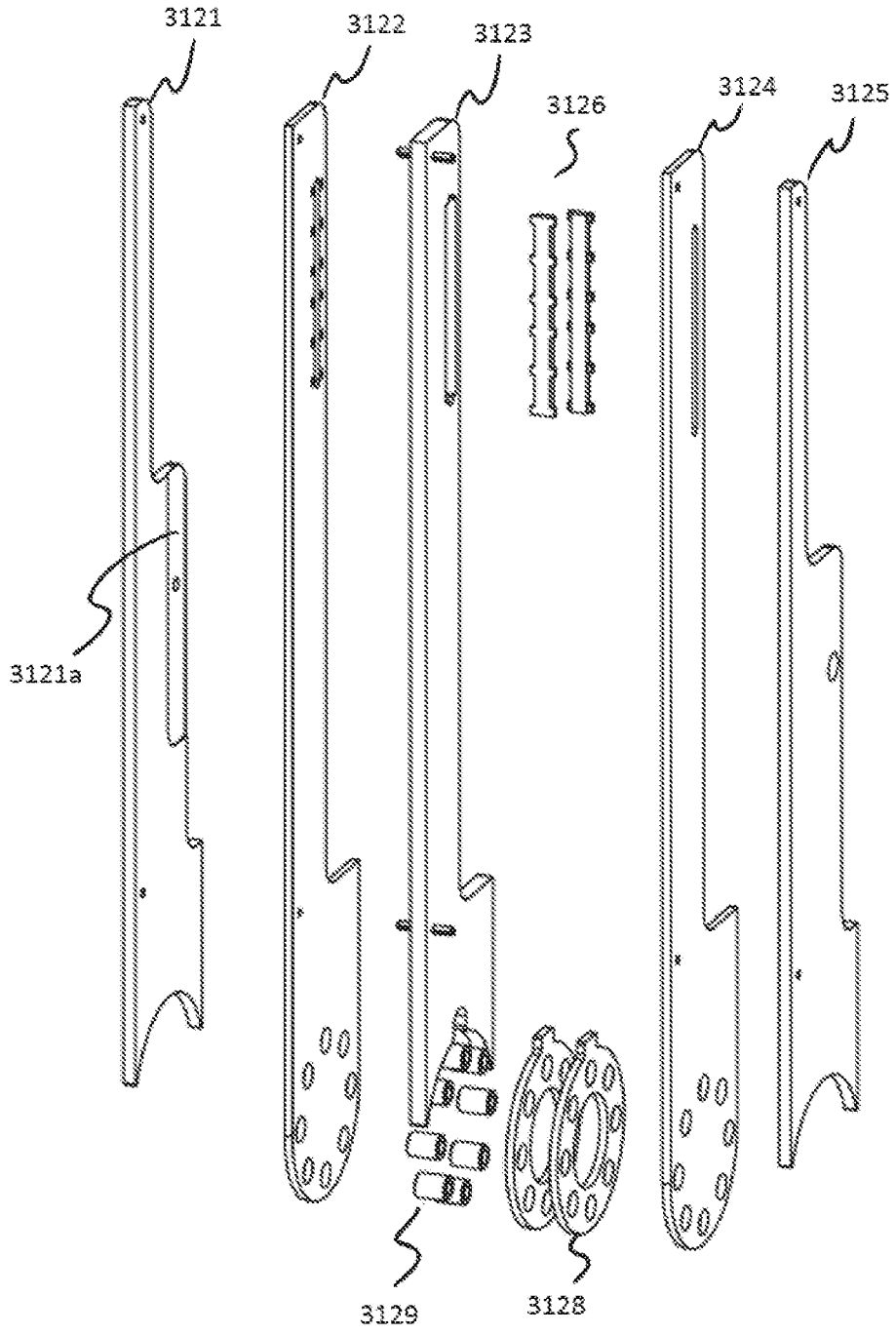
Figure 13:
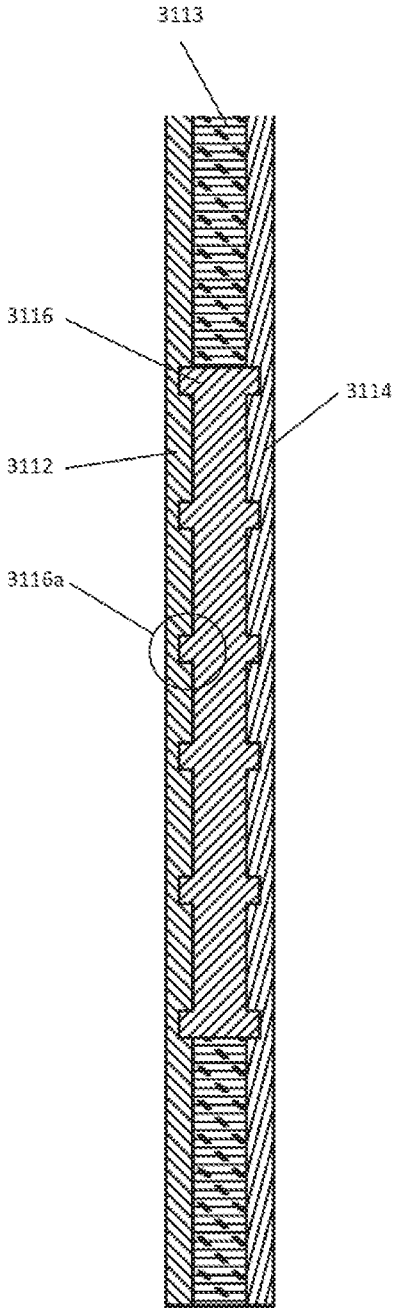
FIGS. 13 and 14 illustrate details of an embodiment of the exoskeleton according to the invention.

The shank segment also comes in two variations: Fixed-length 3130 (FIG. 9) and variable length 3110, 3120 (FIG. 8). Its length adjustment mechanism is similar to the one implemented in the thigh segment and discussed above. It comes with a few enhancements due to the higher constraints (mechanical constraints) it is subject to. Indeed, due to its lower overall thickness, the bending moments are higher and reinforcements are necessary for it not to break during operation. For instance, in the adjustable length version, two reinforcement plates 3116 (FIG. 13) are inserted perpendicularly along the long hole 3110*a* of the tightening screw 3116. Their effect is two-fold: First, they take the screw tightening force, relieving the low-strength material from this duty, and therefore enabling higher tightening forces of the screw. This leads to a higher overall permitted load of the adjustable length system. Their second effect is to take shear strength in the structure. Thanks to protrusions (3116*a*) in their long edges (the ones in contact to the inner high-strength layers of the segment) that fit inside slits performed in the adjacent faces of the inner high-strength layers 3112, 3114 of the segment, shear force between one of those layers and the opposite one is transmitted through those reinforcement plates and not through the lower-strength material 3113. This increases the overall bending resistance and bending stiffness of the structure.

Figure 14:
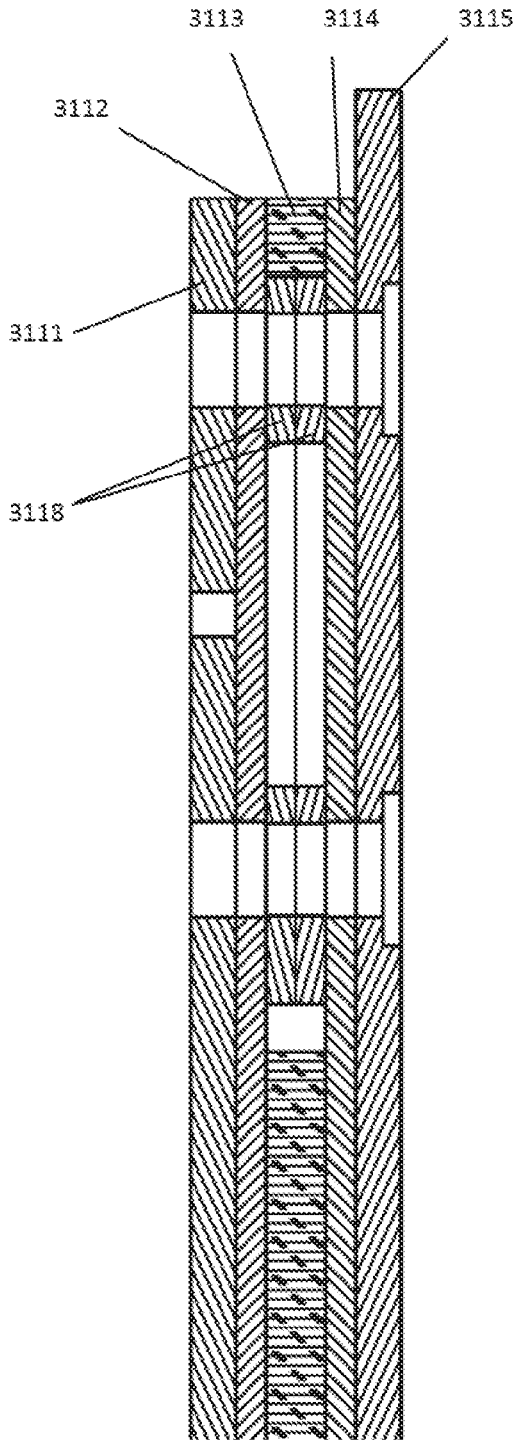

Another option is the addition of reinforcement plates 3118 at the joint interface level, see FIG. 14. These reinforcement plates are made of high-strength material and replace locally the low-strength low-density material 3113. This has a two-fold effect: it enables higher tightening forces of the joint interface screws, thus relieving the low-strength low-density material. The second effect is to take shear stresses from one layer (3112) to the other (3114) and vice-versa, thus increasing the bending resistance and bending stiffness of the whole structure. It acts concurrently with the reinforcement plates mentioned above.

Figure 27:
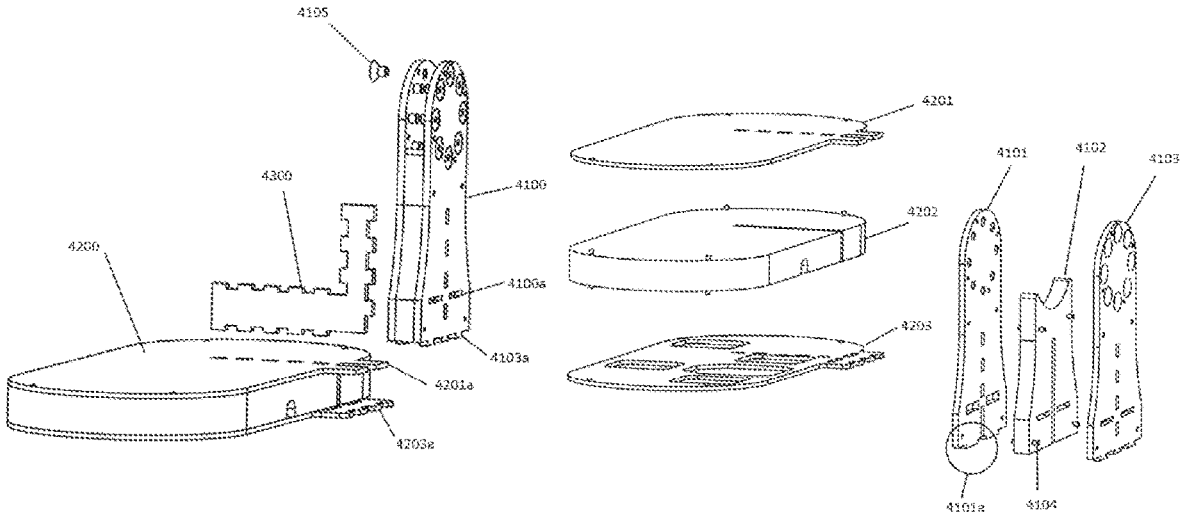
FIGS. 27 to 28 illustrate perspective views of fixed plane conversion according to embodiments of the present invention
Figure 28:
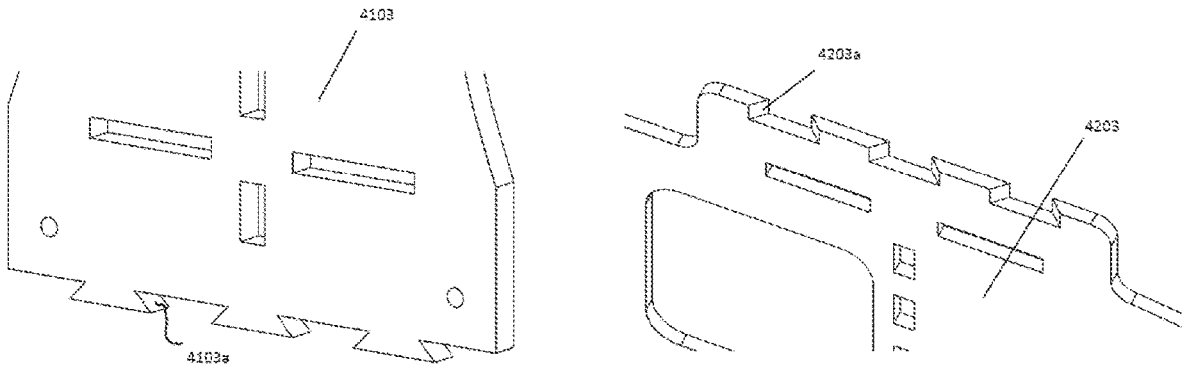
Figure 29:
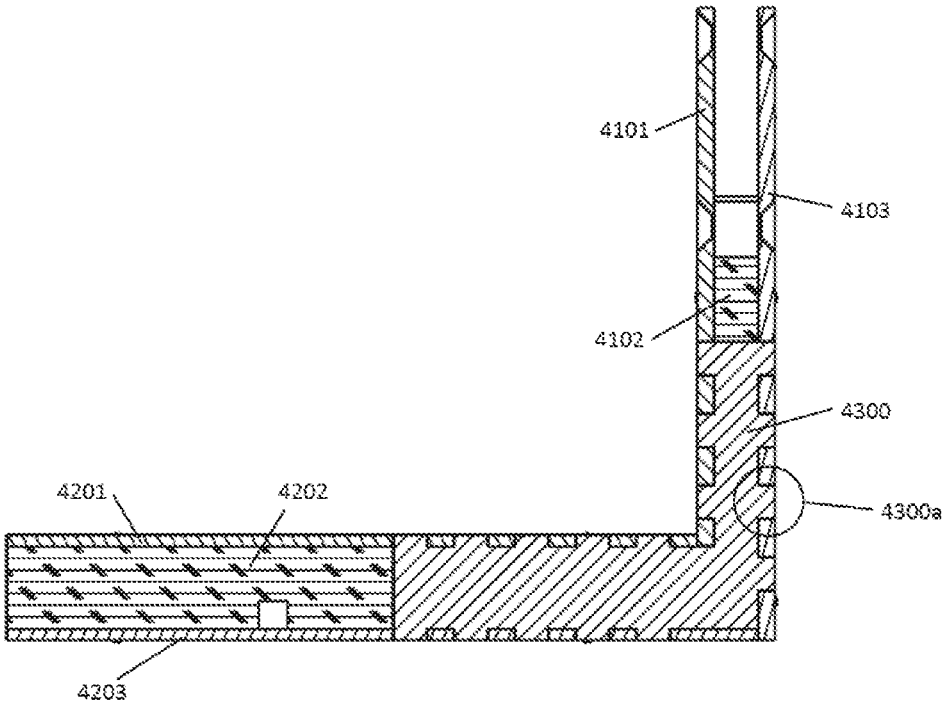
FIG. 29 illustrates a detail of a reinforcing element used for the plane version mechanism according to an embodiment of the present invention.

Another option is the interface with a footplate 4200 or any similar module, see FIGS. 27 to 29. To increase modularity, the foot module can be separated from the shank at the ankle level. To this end, a fixation point is implemented using fileted inserts 3129 and screws 4105. The ankle segment is made with a fork, the two high-strength layers 4101, 4103 being longer than the inner, low-strength low-density layer 4102 (see FIG. 14). They hence overlap with the inner high-strength layers of the shank segment 3122, 3124. In this overlapping area, the inner low-strength layer 3123 of the shank segment is replaced with one or more reinforcement plates 3128 which take compressive loads as well as shear stresses between the inner high-strength layers, in a similar fashion to parts 3118. All layers of the shank segment in this overlap area are perforated to accommodate fileted inserts 3129. The outer layers 4101, 4103 of the ankle segment are also perforated at the same locations than the inserts to let the fixation screws 4105 go through.

Joint Actuation

In some embodiments, the joints will include actuation means and in some other embodiments, no actuation means will be provided depending on the application of the exoskeleton for example. They may be blocked or a passive joint mechanism.

Examples of Actuation Components (FIGS. 17 to 23) in an Actuated Embodiment Each actuated joint, for example the hip and the knee, may comprise as a preferred option:

1. an electrical motor 2201,
2. a transmission 2202, 2203, for example a belt transmission
3. a harmonic drive reducer with output bearings 2204, for example.

All these components are known per se and are used as such or may be replaced by equivalent devices suitable for the purpose. In order to minimize space usage, the motor is reversed with respect to the harmonic drive, the two axes being parallel but without outputs in opposite directions. The belt enables a first reduction ratio which can be modified by changing the sprockets. It also enables deporting the motor to the side of the harmonic drive instead of being directly coaxial.

To exemplify the advantageous modularity of the present invention, non-limiting examples of actuation which are very well suited to the principles of construction described in this invention are given below:

Option 2: using a bigger motor (2201') and a similar belt-stage reducer (2202') but possibly with a different speed ratio Option 3: using a motor (2201") oriented in the same direction than the exoskeleton segment and using a collinear (for instance planetary) reducer (2202"), a right-angle transmission (2203") and an output bearing (2204")

Option 4: using a flat motor included in the segment (2201'"), a belt-stage (2202'") and a harmonic-drive unit or equivalent (2204'")

Figure 23:
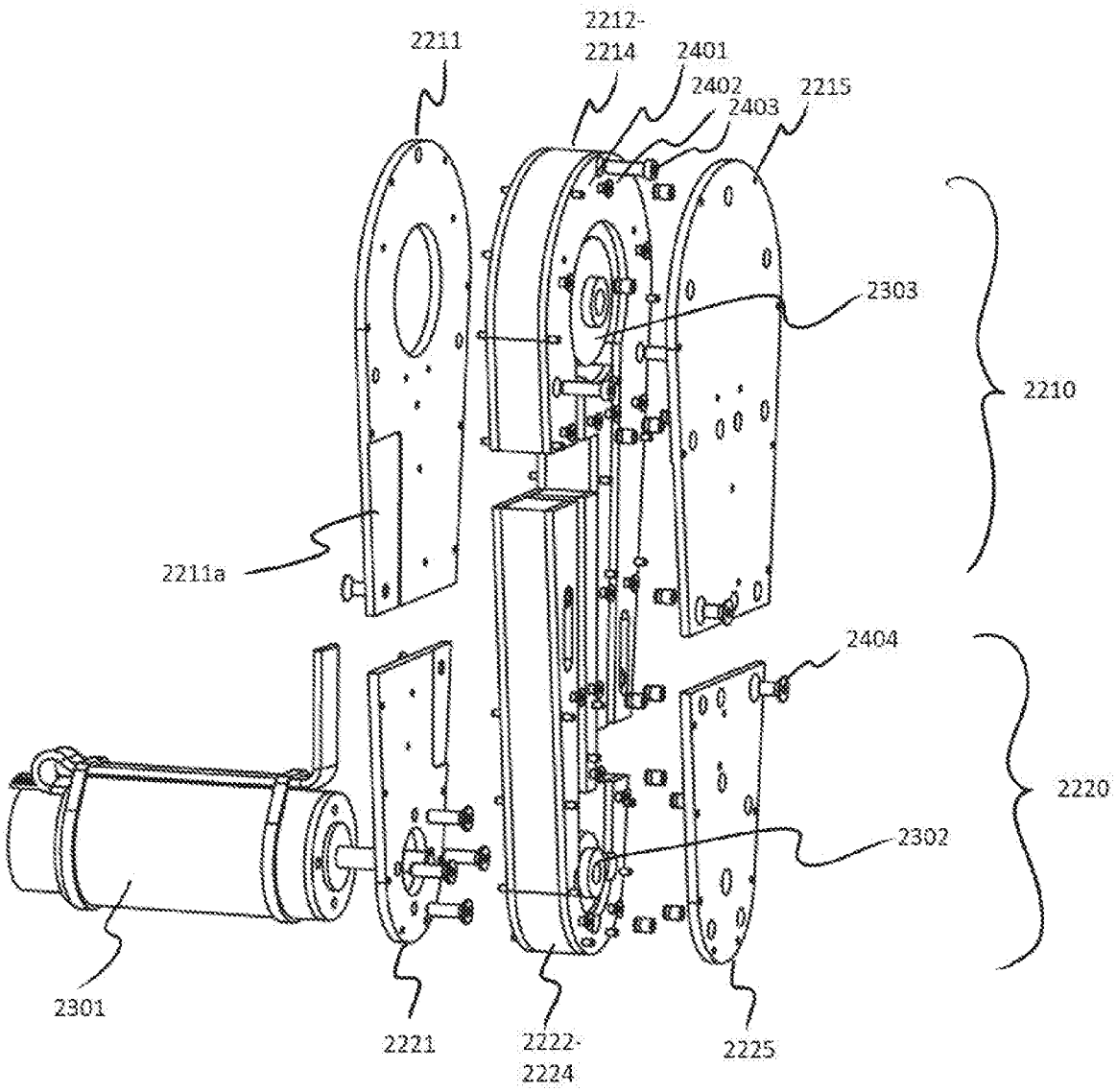
FIG. 23 illustrates in perspective and exploded views a part of an embodiment of an exoskeleton according to the present invention, for example comprising the parts illustrated in FIGS. 18 and 19.
Figure 24:
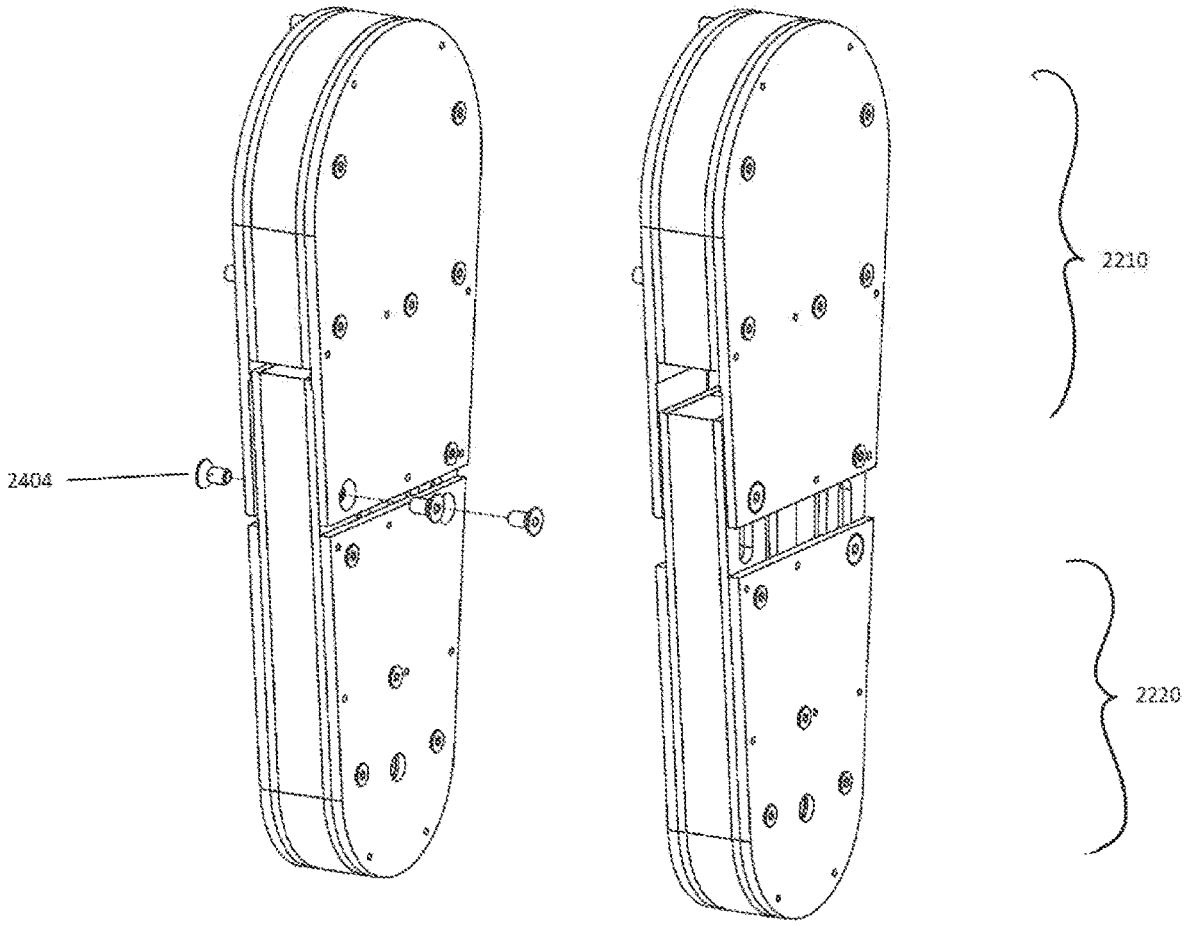
FIG. 24 illustrates the two states of the belt reducer: before and after tensioning of the belt and tightening of the screws.

Belt Stage Reducer FIG. 23

A belt stage as used in this embodiment is preferably formed of three elements: an output sprocket 2302, an input sprocket 2303 and a belt. The belt needs to be under tension to operate properly. To apply this tension, a tensioning mechanism may be implemented in an embodiment. Such mechanism is inspired from the length adjustment mechanism of the segments.

Figure 20:
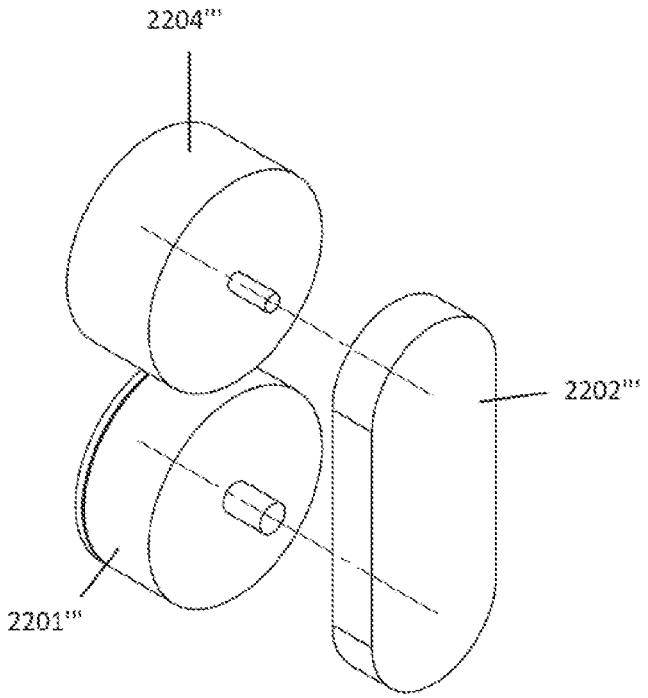
Figure 21:
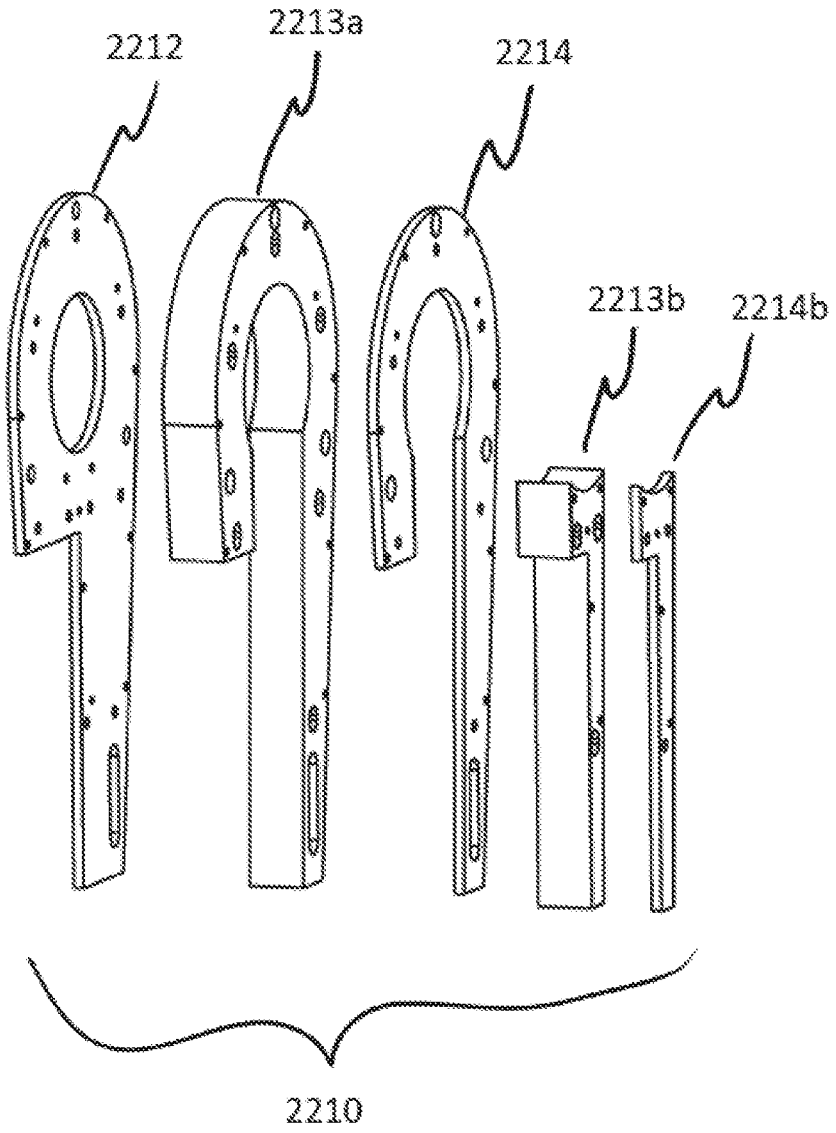
FIGS. 21 and 22 illustrates in perspective and exploded views of parts of an embodiment of an exoskeleton according to the present invention.
Figure 22:
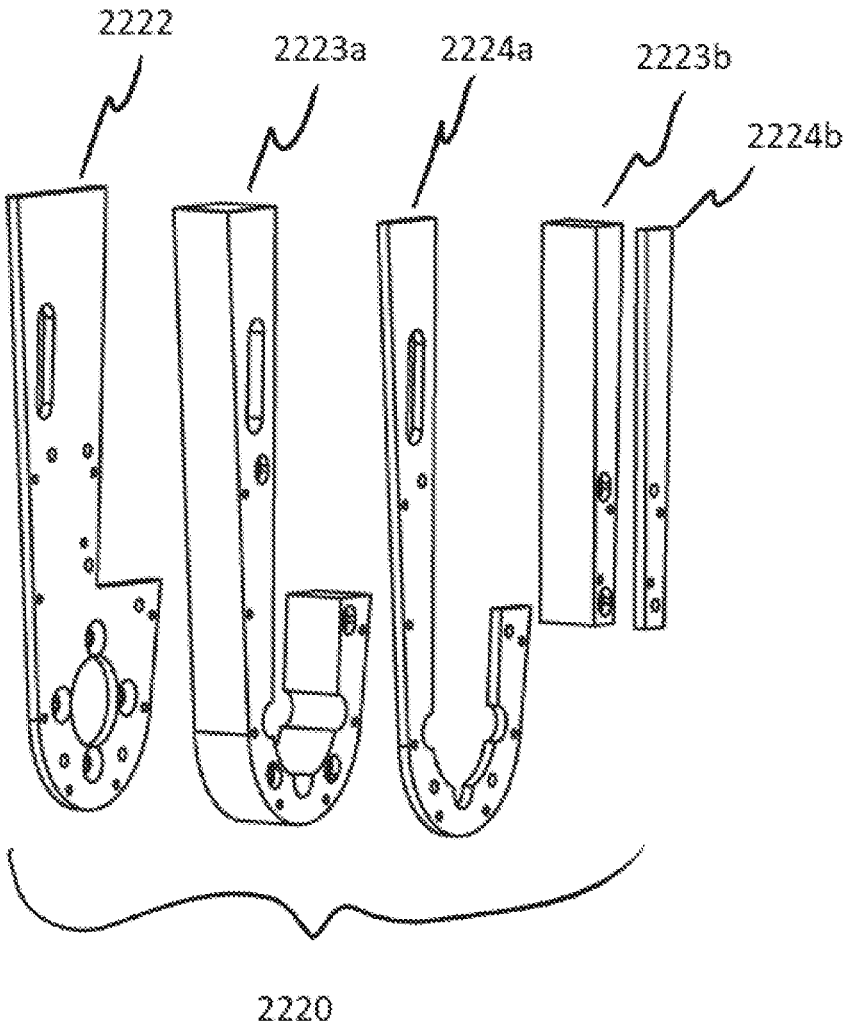

The tensioning mechanism comprises two parts: a motor part 2220 holding the electrical motor and therefore defining the position of its axis, and a harmonic drive part 2210, fixed with respect to the harmonic drive body and therefore defining the position of its input axis, see FIG. 20.

As illustrated in FIGS. 17 to 23, the two parts include each a central layer, made of low-strength and low-density material 2213, 2223, two inner high strength layers 2212, 2214, 2222, 2224, glued to the inner low strength layer, and two outer high strength layers 2211, 2221, 2215, 2225, either glued or rigidly mounted using pins and screws to the inner high strength layers 2212, 2214, 2222, 2224. Each layer can be made of one or several parts. In particular, the inner high-strength layers and the low-strength layer need to accommodate the belt and therefore may be made of several parts.

The two parts of the belt stage can fit inside each other and slide with respect to each other. The outer layers 2211, 2215, 2221, 2225 have a shape such that they overlap the inner high strength layers of the other part 2222, 2224, 2212, 2214 and uncover some a portion of the surface of the inner high strength layers of their part for the outer high strength layers of the other part to overlap with them.

In order to set the system to a given distance between the motor axis and the harmonic drive axis, a pair of fasteners (2404) are used to clamp the outer layers of one part onto the inner layers of the other part.

To increase friction between these parts, one of them can be covered or coated with a higher coefficient of friction material in the contact area 2211*a* or have dedicated features to this effect (complementary shaped elements for example)

Plane Conversion Mechanisms (FIGS. 25-29)

The plane conversion enables evolving from one plane (for instance the sagittal plane, as it is the case for the segments) into another plane, such as the horizontal plane as it is the case for the interface fixations 2400, 3400. It is difficult to realize this plane conversion while keeping high structural resistance. The present design includes two plane conversion mechanisms: one that can be disassembled for modularity and maintenance purposes for instance, and one that is fixed and cannot be undone.

Figure 25:
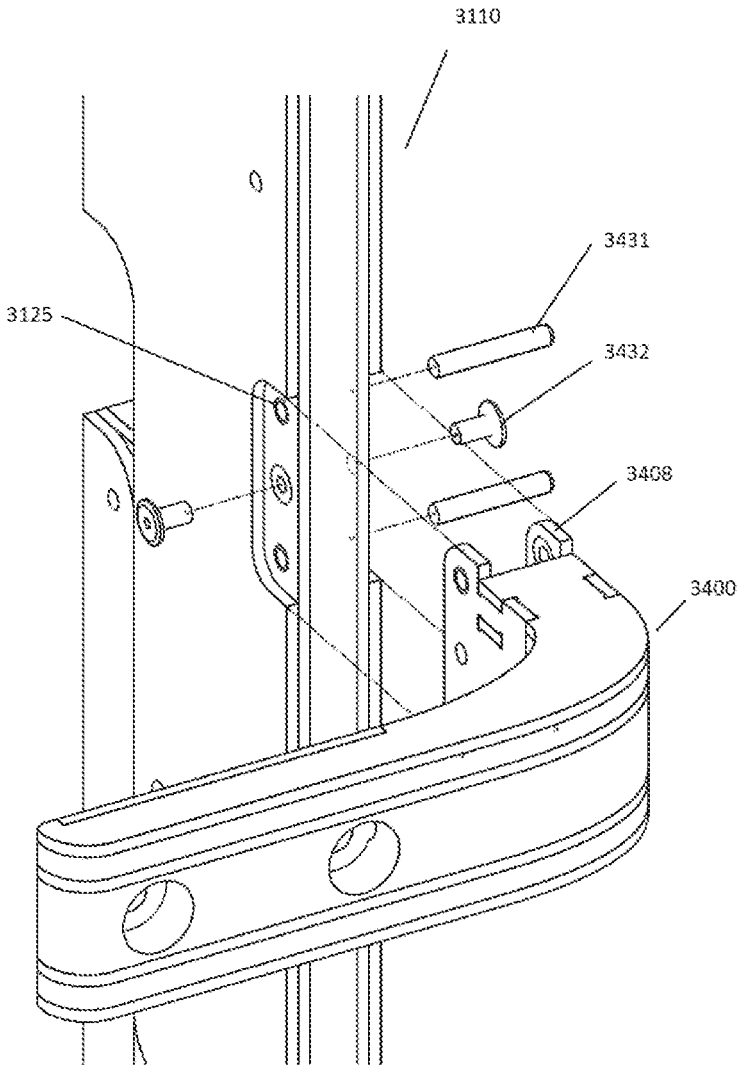
FIGS. 25-26 illustrates embodiments of movable plane conversion according to embodiments of the present invention.
Figure 26:
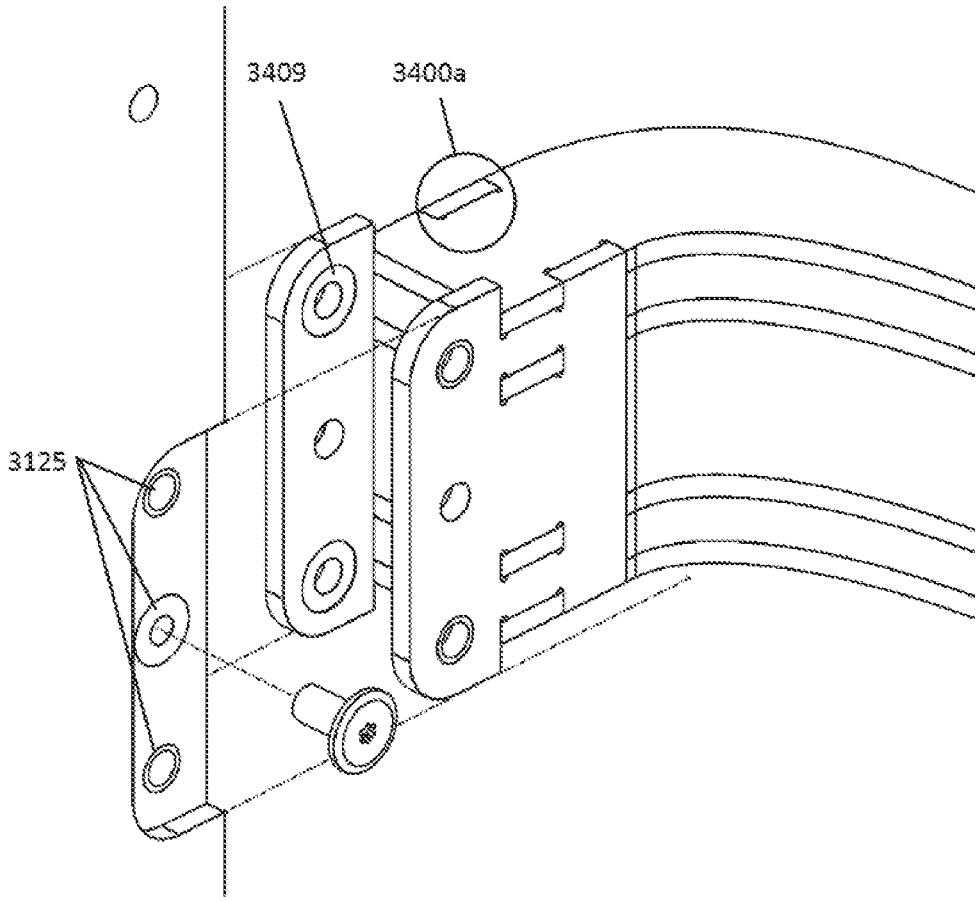

Movable Plane Conversion (FIGS. 25-26)

In an embodiment, the movable plane conversion is used to create the mechanical interface with the user. This serves the purpose of an example solely, as a moveable plane conversion could be useful also in any other locations of the system, such as for providing an additional handle for manipulation, or to mount an actuation component.

The moveable plane conversion preferably comprises:

1. a first part with sandwich structure, manufactured with the aforementioned technique (2110, 3110)

2. a second part also made with the same technique (2400, 3400), 3. some lateral fastening parts, made of a high strength material, also produced with the same manufacturing technique (3408), 4. some fasteners such as dowel pins or screws or any equivalent means to hold the second part in place (3431, 3432).

Note that some additional reinforcement parts could be added to increase the strength of the plane conversion.

The second part can be made of any number of layers to fulfill the strength requirements. In an embodiment, seven layers are provided, alternating high-strength and low-strength materials. On the side that should be attached to the first part, some notches (3400*a*) are performed in the high-strength layers. These notches are compatible with the third, fastening part, such that they transmit forces when loaded. The fastening parts have holes to accommodate inserts as well as passing holes for one or more screws. The fastening parts 3408 form a fork, that will go on either side of the first part 3110 when assembled. The first part's high strength (the outer ones, the inner ones or both) layers have holes to accommodate inserts 3125, such that they align with the inserts 3409 of the fastening part 3408 when the second part 3400 and the fastening parts 3408 are in the fitting position. Once in the fitting position, positioning elements such as dowels 3431 and screws 3432 can be fitted inside the inserts to keep the second part 3400 and the fastening part 3408 in position.

Fixed Plane Conversion (FIGS. 27 to 29)

In the fixed-type conversion, all parts are fixed together and cannot be removed without breaking some of the structure. It is the case of the foot plate, where the plane of the plate is horizontal, whereas the plane of the ankle segment is vertical. The conversion is made through different alterations of the sandwich parts such that they fit inside each other and transmit forces and moments of forces once assembled and glued. In this embodiment, there are two subsystems with specific functions, but as for the movable plane conversion, the fixed plane conversion could be used for any other purpose than at the ankle joint.

In this embodiment, the plane conversion mechanism is used to join the two following subsystems:

1, the footplate 4200, 2. the ankle segment 4100.

Figure 17:
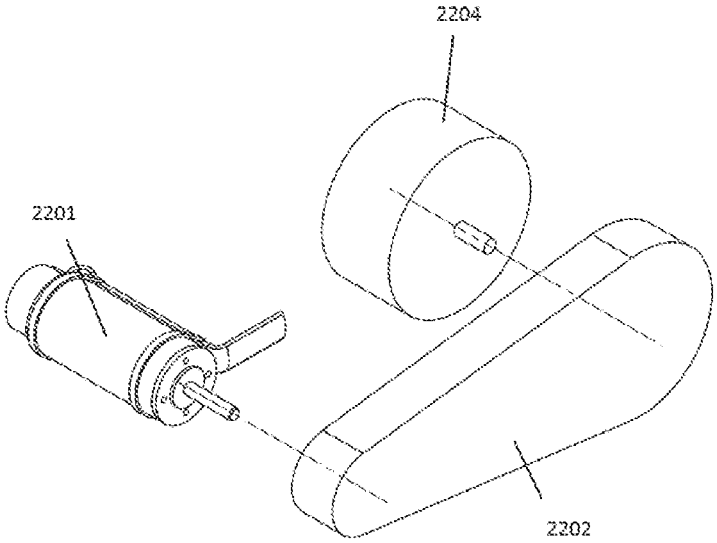
FIGS. 17 to 20 illustrate example of actuation elements.
Figure 18:
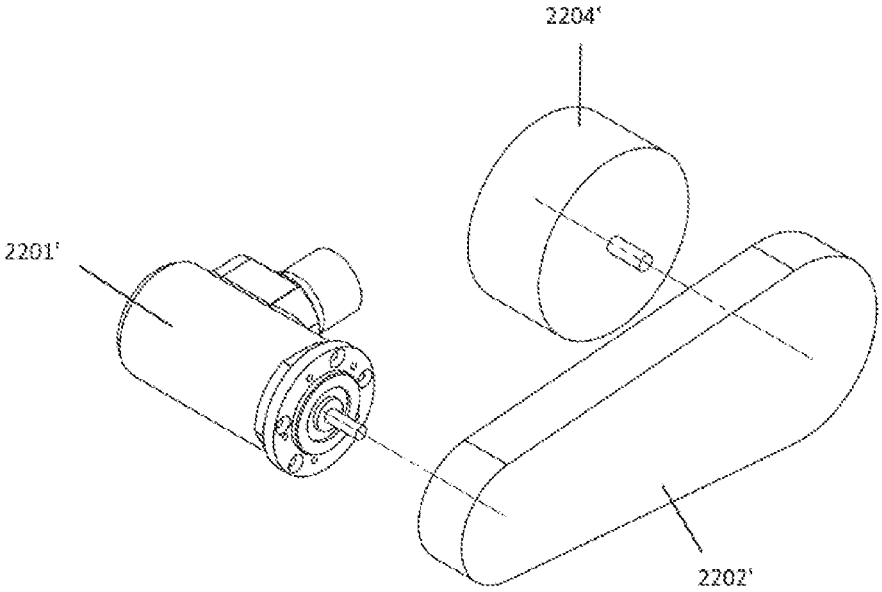
Figure 19:
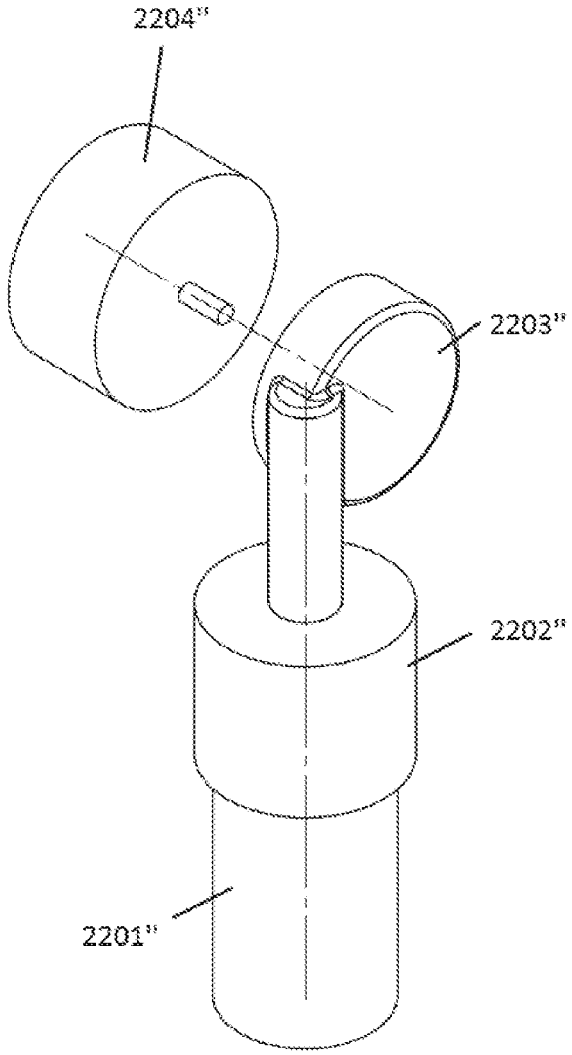

An optional third subsystem 4300 can be added to increase further the strength of the conversion, as described further below. The footplate preferably comprises three layers, manufactured with the aforementioned process. The outermost layers are of high-strength material 4201, 4203, and the inner layer is of lower-strength and lower density material 4202. The upper layer comprises one or more protrusions 4201*a*. The lower plate comports dovetails slits 4203*a*, oriented either across the plate's thickness, or along the plate's width. The ankle segment also preferably comprises three layers, manufactured with the aforementioned technique. All three layers 4101, 4102, 4103 are made with a slit 4100*a* to fit the protrusions of the footplate's upper layer 4201. The inner layer 4101 also has one or more protrusions 4101*a* made to fit in the footplate's lower layer 4203. The outer layer 4103 has dovetails on the lower edge 4103*a* (FIG. 16), made to fit the dovetails of the footplate's lower layer 4203*a* (FIG. 17).

To increase the conversion strength, an additional part 4300 can be included. It has a shape of a right angle and has slits and protrusions 4300*a* on or more of its edges. Its width is such that it can fit between the high-strength layers of either parts of the conversion (4100 and 4200) and such that forces are transmitted from flexion of one plate to traction of the other one.

All the examples and embodiments described in the present application are for illustration purposes and should not be construed in a limiting manner. The present invention encompasses many variations all within the scope and spirit of the invention. For example, embodiments described herein may be combined together and equivalent means may be used as well.

Figure 30:
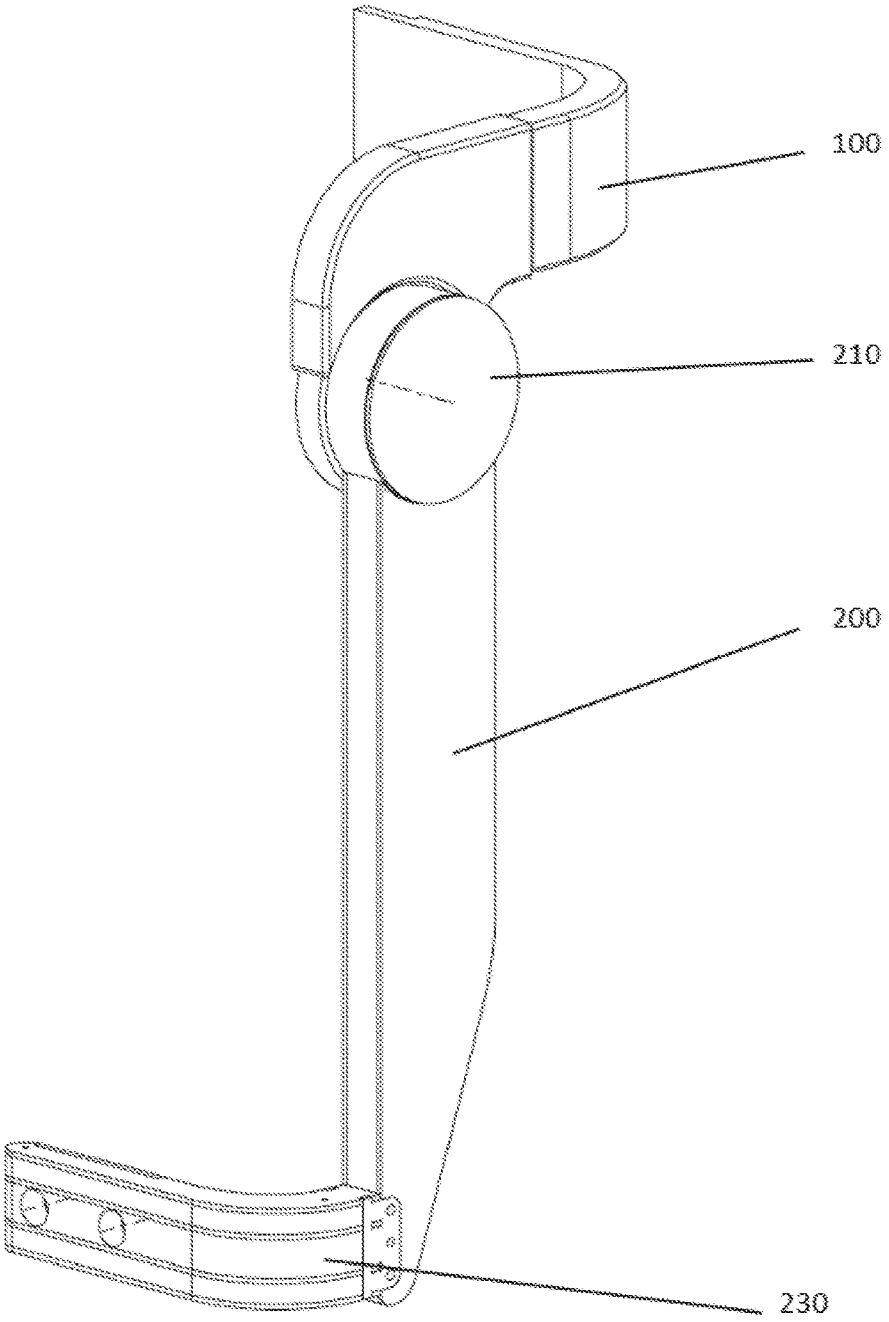
FIG. 30 illustrates another embodiment of the present invention.

For example, FIG. 30 illustrates another embodiment also made according to the method described in the present invention, and using one or more mechanisms as disclosed herein. In this other embodiment, only the hip joint 210 is actuated, the segment 200 is made in a sandwich construction using the method of the present invention, and the thigh interface 230 is mounted using the moveable plane conversion as described in FIG. 25.

Also, in some embodiments, the exoskeleton may comprise electronic means to control the overall system and manage its movements and displacements. Such electronic means typically include computer means, communication means (wire or wireless), control means either external managed by third parties or managed by the user of the exoskeleton. For example, this could be buttons or joysticks appropriately arranged on the device for actuation by the user. Many other control means may be envisaged, such as optical means or position sensors which could interpret orders from the user and translate them into commands for the exoskeleton.

Exemplary embodiments have been described to provide an overall understanding of the principles of the structure, function, manufacture, and use of the devices and methods disclosed herein. One or more examples of these embodiments are illustrated in the accompanying drawings. Those skilled in the art will understand that the systems/devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. A number of problems with conventional methods and systems are noted herein and the methods and systems disclosed herein may address one or more of these problems. By describing these problems, no admission as to their knowledge in the art is intended. A person having ordinary skill in the art will appreciate that, although certain methods and systems are described herein with respect to an exoskeleton, the scope of the present invention is not so limited.

Moreover, while this invention has been described in conjunction with a number of embodiments, it is evident that many alternatives, modifications and variations would be or are apparent to those of ordinary skill in the applicable arts. Accordingly, it is intended to embrace all such alternatives, modifications, equivalents and variations that are within the spirit and scope of this invention.

What is claimed is:

1. An exoskeleton comprising:

articulated segments forming a structure of the exoskeleton;

body interface parts for attaching the exoskeleton to a user; and a joint arranged between two of the articulated segments, wherein the articulated segments include a sandwich construction, the sandwich construction including:

two outer layers made of a higher-strength material, and an inner core layer made of a lower-strength material as compared to the higher-strength material, the inner core layer having a thickness that is thicker than a thickness of the outer layers.

2. The exoskeleton as defined in claim 1, wherein the exoskeleton is formed as a limb exoskeleton including the two articulated segments via the joint.

3. The exoskeleton as defined in claim 1, wherein at least one of the articulated segments includes two parts, one part having a longitudinal slit and the other part having a corresponding hole for allowing an individual length adjustment of the one segments.

4. The exoskeleton as defined in claim 2, wherein the exoskeleton is formed as a lower limb exoskeleton, and the two articulated segments form a thigh and a shank of a leg, respectively.

5. The exoskeleton as defined in claim 2, wherein the exoskeleton is formed as an upper limb exoskeleton with the two articulated segments forming a forearm and an arm, respectively.

6. The exoskeleton as defined in claim 1, wherein the sandwich construction includes two additional outer layers, the additional outer layers located between the inner core layer and one of the outer layers, the two additional outer layers having the same outline as the inner core layer.

7. The exoskeleton as defined in claim 1, wherein at least one of the body interface parts includes:

a fork element for attachment to the sandwich construction of the articulated segments, the fork element formed by two parallelly-arranged plates.

8. The exoskeleton as defined in claim 1, further comprising:

reinforcement plates interconnected between the two outer layers, traversing the inner core layer.

9. The exoskeleton as defined in claim 1, wherein the joint includes a motor for a joint actuation.

10. The exoskeleton as defined in claim 9, further comprising:

a belt transmission actuated by the motor.

11. The exoskeleton as defined in claim 10, further comprising:

a belt tensioner for tensioning the belt.

12. The exoskeleton as defined in claim 1, wherein the inner core layer is made of at least one of a cell foam, a wood, and a honeycomb, and the outer layers are made of at least one of a carbon fiber composite, and a fiber reinforced polymer.

13. The exoskeleton as defined in claim 1, wherein the sandwich construction further includes:

two adhesive layers located between the outer layers and the inner core layer.

14. The exoskeleton as defined in claim 7, wherein the two outer layers each have an opening to accommodate the two parallelly-arranged plates of the fork element.

* * * * *